US009138110B2

(12) United States Patent
Knight et al.

(10) Patent No.: US 9,138,110 B2
(45) Date of Patent: Sep. 22, 2015

(54) TISSUE DISPENSER, METHOD FOR DISPENSING TISSUE, AND TISSUE DISPENSER INSERT

(75) Inventors: Daniel J. Knight, Nicholasville, KY (US); Adam T. Elliott, Lexington, KY (US)

(73) Assignee: Wausau Paper Towel & Tissue, LLC, Mosiness, WI (US)

( * ) Notice: Subject to any disclaimer, the term of this patent is extended or adjusted under 35 U.S.C. 154(b) by 670 days.

(21) Appl. No.: 13/190,208

(22) Filed: Jul. 25, 2011

(65) Prior Publication Data

US 2013/0026281 A1 Jan. 31, 2013

(51) Int. Cl.

| | |
|---|---|
| ***B65H 19/00*** | (2006.01) |
| ***A47K 10/38*** | (2006.01) |
| *A47K 10/32* | (2006.01) |

(52) U.S. Cl.

CPC ..... *A47K 10/38* (2013.01); *A47K 2010/3253* (2013.01)

(58) Field of Classification Search

USPC ..... 242/558, 559, 560, 560.2, 561, 597, 242/597.5, 597.6, 597.8, 599, 599.3, 599.4

See application file for complete search history.

(56) References Cited

U.S. PATENT DOCUMENTS

| | | | | |
|---|---|---|---|---|
| 2,873,928 A | | 2/1959 | Klasky | |
| 3,381,909 A | * | 5/1968 | Tucker et al. | 242/560.3 |
| 3,387,902 A | * | 6/1968 | Perrin et al. | 312/34.22 |
| 3,650,487 A | * | 3/1972 | Bahnsen | 242/560.3 |
| 3,677,485 A | * | 7/1972 | Berg | 242/560.3 |
| 4,212,434 A | | 7/1980 | Walker | |
| 4,422,584 A | * | 12/1983 | Dashnier et al. | 242/560.3 |
| 4,422,585 A | * | 12/1983 | Schultz et al. | 242/560.3 |

(Continued)

FOREIGN PATENT DOCUMENTS

| | | |
|---|---|---|
| EP | 0 758 539 A1 | 2/1997 |
| GB | 1 422 674 | 1/1976 |

OTHER PUBLICATIONS

GP4685 "Compact®—Coreless Bath Tissue & Dispensers," Georgia-Pacific Consumer Products LP, 2008, (8 pages).

(Continued)

*Primary Examiner* — Emmanuel M Marcelo
*Assistant Examiner* — Justin Stefanon
(74) *Attorney, Agent, or Firm* — Merchant & Gould, P.C.

(57) ABSTRACT

A tissue dispenser is provided according to the present invention. The tissue dispenser includes a housing for storing and dispensing multiple rolls of tissue, and a mandrel set constructed to move within the housing. The housing includes a first side wall and a cover constructed to provide an opening through which tissue can be dispensed, and a track extending along a portion of the first side wall. The mandrel set includes a first mandrel constructed to hold a first roll of tissue, a second mandrel constructed to hold a second roll of tissue, and an arm extending from the first mandrel to the second mandrel. The arm includes a first pin and a second pin wherein the first pin and the second pin are constructed to engage and travel along the track. The tissue dispenser is constructed so that a roll of tissue on the first mandrel can be dispensed from the opening while the roll of tissue on the second mandrel is held in reserve, and once the roll of tissue on the first mandrel is depleted, the mandrel set can move along the track so that the roll of tissue on the second mandrel can be dispensed from the opening. A method of dispensing tissue, and a tissue dispenser insert for retrofitting a tissue dispenser are provided.

19 Claims, 24 Drawing Sheets

(56) References Cited

U.S. PATENT DOCUMENTS

| | | | | |
|---|---|---|---|---|
| 4,522,346 | A | 6/1985 | Jespersen | |
| 5,310,129 | A * | 5/1994 | Whittington et al. | 242/560.3 |
| 5,495,997 | A | 3/1996 | Moody | |
| 5,558,302 | A | 9/1996 | Jesperson | |
| 5,628,474 | A * | 5/1997 | Krueger et al. | 242/559.4 |
| 5,690,299 | A * | 11/1997 | Perrin et al. | 242/560 |
| 5,813,624 | A | 9/1998 | Grasso et al. | |
| 5,873,542 | A * | 2/1999 | Perrin et al. | 242/560 |
| 6,202,956 | B1 | 3/2001 | Grasso et al. | |
| 6,439,502 | B1 | 8/2002 | Gemmell et al. | |
| 6,491,251 | B1 | 12/2002 | Stanland et al. | |
| 6,648,267 | B2 | 11/2003 | Stanland et al. | |
| 6,854,684 | B2 | 2/2005 | Byrd et al. | |
| 7,014,140 | B2 | 3/2006 | Elliott et al. | |
| 7,083,138 | B2 | 8/2006 | Elliott et al. | |
| 7,107,888 | B2 | 9/2006 | Blume et al. | |
| 7,316,369 | B2 | 1/2008 | Phelps | |
| 7,568,652 | B2 * | 8/2009 | Cittadino et al. | 242/594.4 |
| 7,967,235 | B2 * | 6/2011 | Forman et al. | 242/560 |
| 8,439,293 | B2 * | 5/2013 | Hagleitner | 242/560.3 |
| 2003/0146337 | A1 * | 8/2003 | Moody et al. | 242/594 |
| 2008/0078855 | A1 * | 4/2008 | Forman et al. | 242/560 |

OTHER PUBLICATIONS

GP4979 "Compact®—Universal Spindles Placement Guide," Georgia-Pacific Consumer Products LP, 2007(4 pages).

International Search Report and Written Opinion for PCT/US2012/048133, mailed Oct. 30, 2012.

* cited by examiner

TISSUE DISPENSER, METHOD FOR DISPENSING TISSUE, AND TISSUE DISPENSER INSERT

FIELD OF THE INVENTION

The disclosure generally relates to a tissue dispenser, a method for dispensing tissue and, a tissue dispenser insert. The disclosure provides for conservation of tissue, such as toilet tissue, by requiring that a first roll of tissue is exhausted before a second roll of tissue can be accessed.

BACKGROUND OF THE INVENTION

Numerous styles of tissue dispensers are available. One style of tissue dispenser found in many commercial establishments is a tissue dispenser where two rolls of tissue are located side by side. For that style of tissue dispenser, it is often the problem that a user will begin the second roll of tissue before the first roll of tissue is exhausted. The custodian who services the tissue dispenser often ends up replacing both partially used rolls with new rolls of tissue thereby resulting in waste. Examples of two roll dispensers are disclosed in U.S. Pat. Nos. 6,439,502; 6,202,956; 5,813,624; and 3,381,909. A dispenser that helps reduce waste by requiring depletion or substantial depletion of a first roll before access to a second roll is made available is disclosed in U.S. Pat. No. 7,083,138.

One type of tissue dispenser includes a metal housing typical of the dispenser shown in FIG. 1. The housing 10 includes a slot or opening 12 through which a first roll of tissue 14 can be accessed. A second roll of tissue 16 sits in reserve above the first roll of tissue 14. When the first roll of tissue 14 is exhausted, the second roll of tissue 16 can fall into place within the opening 12. Typically, a user may access the second roll of tissue 16 before the first roll of tissue 14 is exhausted. Furthermore, the weight of the second roll 16 often presses upon the first roll 14 and hinders the operation of the first roll 14.

Toilet tissue rolls and other paper roll products, such as paper towel rolls, typically comprise a paper web material that is wound around a central core. The core helps to support the paper web material and define the shape of the roll, as well as define a central opening for interaction with a support structure, such as a mandrel, on a suitable dispensing apparatus.

In many paper roll products, the core is a one piece structure that extends the entire width of the roll product. However, in some known paper roll products, the core is formed by core sections that are spaced apart from each other to form a gap between the core sections so that the total length of the core sections is less than the width of the web material wound onto the core sections. These reduced core paper roll products having spaced core sections separated by a gap help to reduce the amount of core stock material that is used in paper roll products. Examples of reduced core paper roll products are disclosed in U.S. Pat. Nos. 7,107,888; 6,648,267; and 6,491,251.

Exemplary tissue dispensers that encourage depletion of a roll of tissue before another roll of tissue is available are disclosed, for example, by U.S. Pat. Nos. 7,014,140; 6,648,267; and 6,491,251. There is a continuing need for tissue dispensers that encourage depletion of a first tissue roll before consuming a second tissue roll.

SUMMARY

A tissue dispenser is provided according to the present invention. The tissue dispenser includes a housing for storing and dispensing multiple rolls of tissue, and a mandrel set constructed to move within the housing. The housing includes a first side wall and a cover constructed to provide an opening through which tissue can be dispensed, and a track extending along a portion of the first side wall. The mandrel set includes a first mandrel constructed to hold a first roll of tissue, a second mandrel constructed to hold a second roll of tissue, and an arm extending from the first mandrel to the second mandrel. Extending from the arm are a first pin and a second pin wherein the first pin and the second pin are constructed to engage and travel along the track. The tissue dispenser is constructed so that a roll of tissue on the first mandrel can be dispensed from the opening while the roll of tissue on the second mandrel is held in reserve, and once the roll of tissue on the first mandrel is depleted, the mandrel set can move along the track so that the roll of tissue on the second mandrel can be dispensed from the opening. The tissue dispenser can be constructed so that the mandrel set is unable to advance to a position where tissue can be dispensed from the second mandrel until the roll of tissue on the first mandrel is depleted.

A method for dispensing tissue from a tissue dispenser is provided according to the present invention. The method includes steps of: dispensing tissue through an opening in a tissue dispenser housing from a lower mandrel of a mandrel set in a first dispensing configuration until the tissue is depleted, the mandrel set having an upper mandrel and the lower mandrel; and displacing the lower mandrel so that the mandrel set moves into a second dispensing configuration for dispensing tissue from the upper mandrel through the opening, wherein the mandrel set has an arm separating the lower mandrel and the upper mandrel, and a pin arrangement so that the mandrel set moves along a track.

A tissue dispenser insert constructed for retrofitting a tissue dispenser housing is provided according to the present invention. The tissue dispenser insert includes: a track having a track inlet, a track outlet, and a track length extending from the track inlet to the track outlet, the track length constructed to provide a first dispensing location and a second dispensing location; and a mandrel set comprising a first mandrel constructed to hold a first roll of tissue, a second mandrel constructed to hold a second roll of tissue, and an arm extending from the first mandrel to the second mandrel, the arm including a first pin and a second pin wherein the first pin and the second pin are constructed to engage and travel through the track from the track inlet to the track outlet.

DETAILED DESCRIPTION

Figure 2:
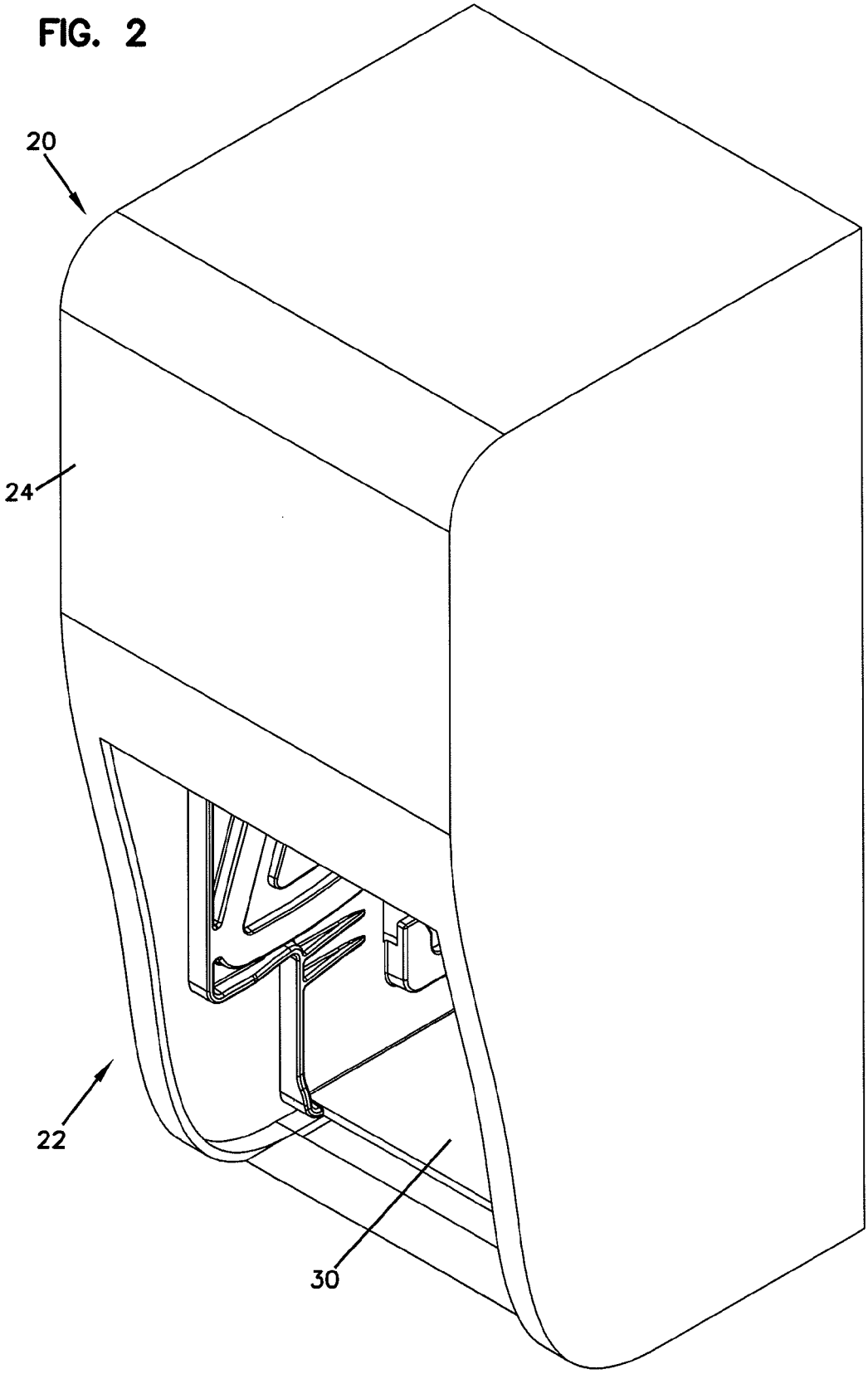
FIG. 2 is a perspective view of a tissue dispenser according to the principles of the invention.
Figure 3:
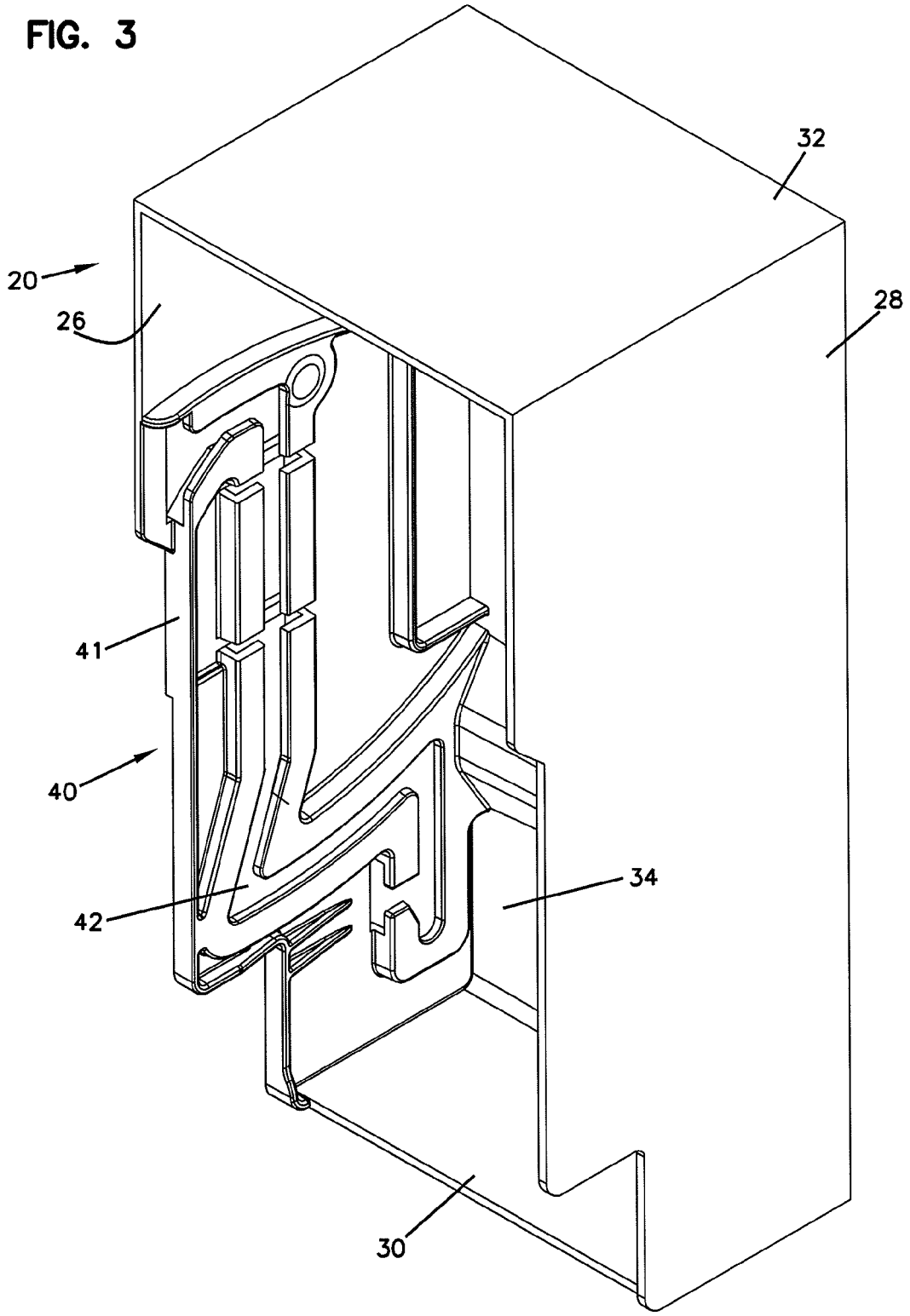
FIG. 3 is a perspective view of the tissue dispenser of FIG. 2 with the cover removed.
Figure 4:
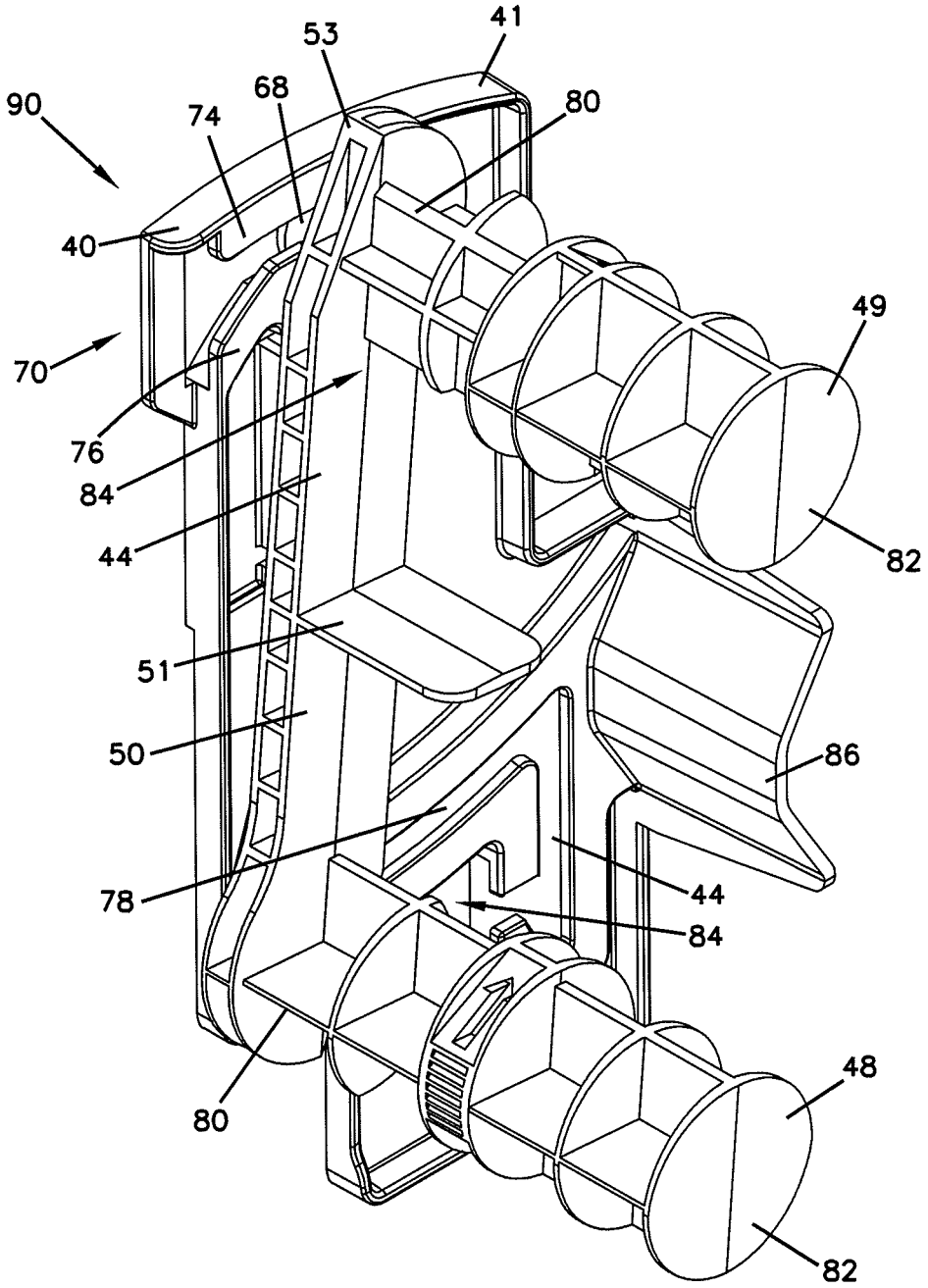
FIG. 4 is a perspective view of the insert of the tissue dispenser of FIG. 2 shown in a first dispensing position.
Figure 5:
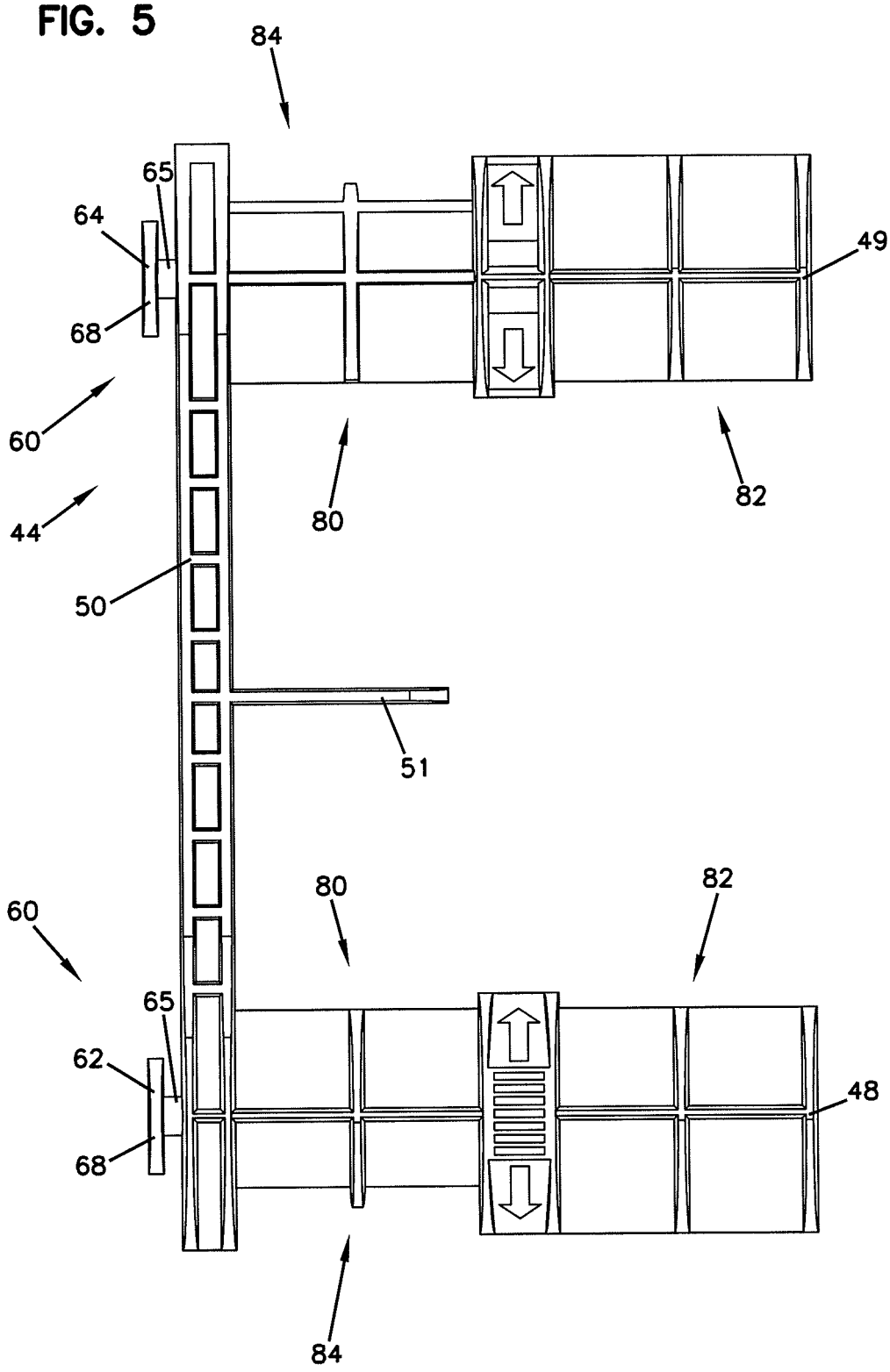
FIG. 5 is a side view of the mandrel set of FIG. 4
Figure 6:
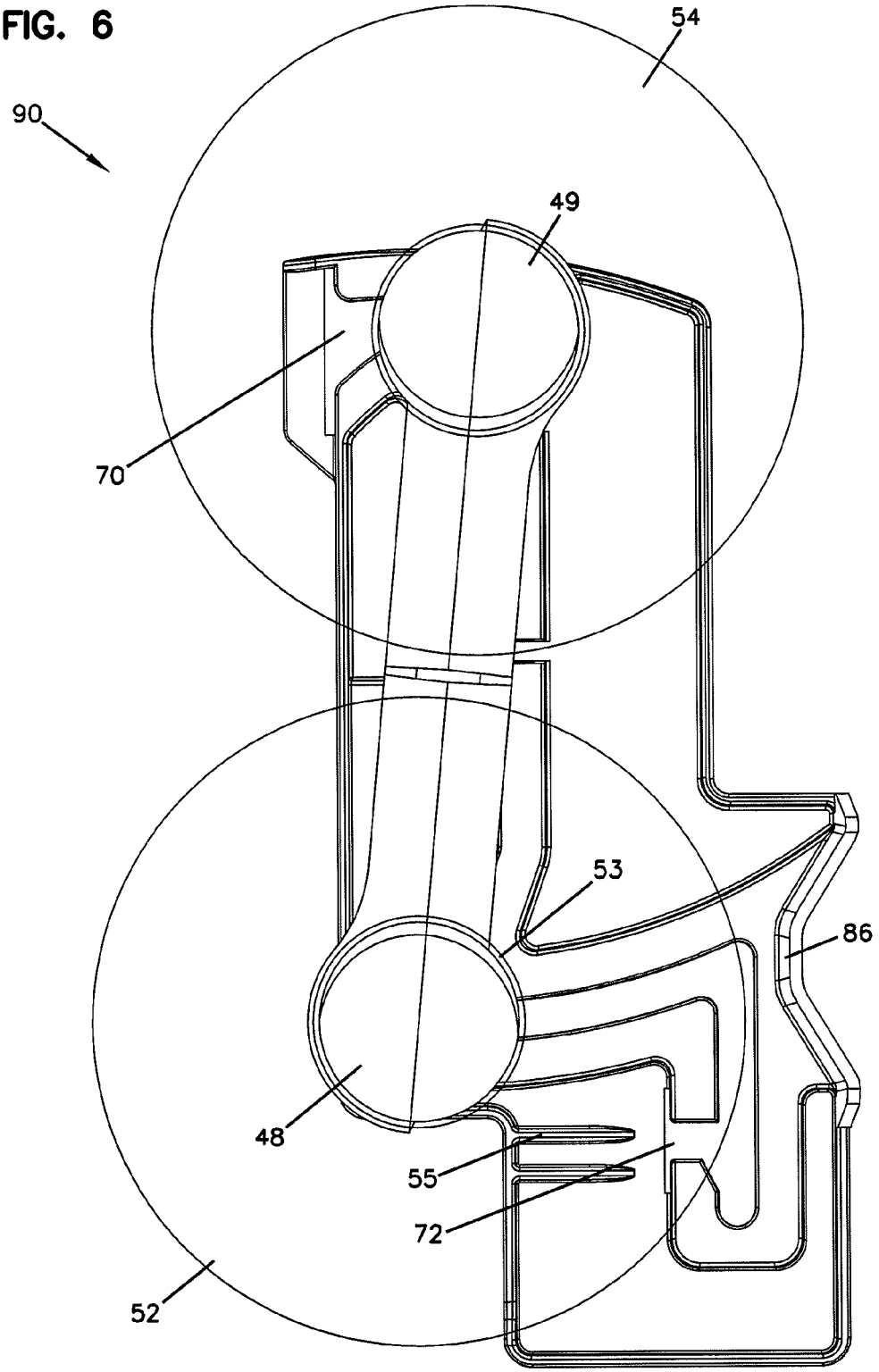
FIG. 6 is a side view of the insert of FIG. 4.
Figure 7:
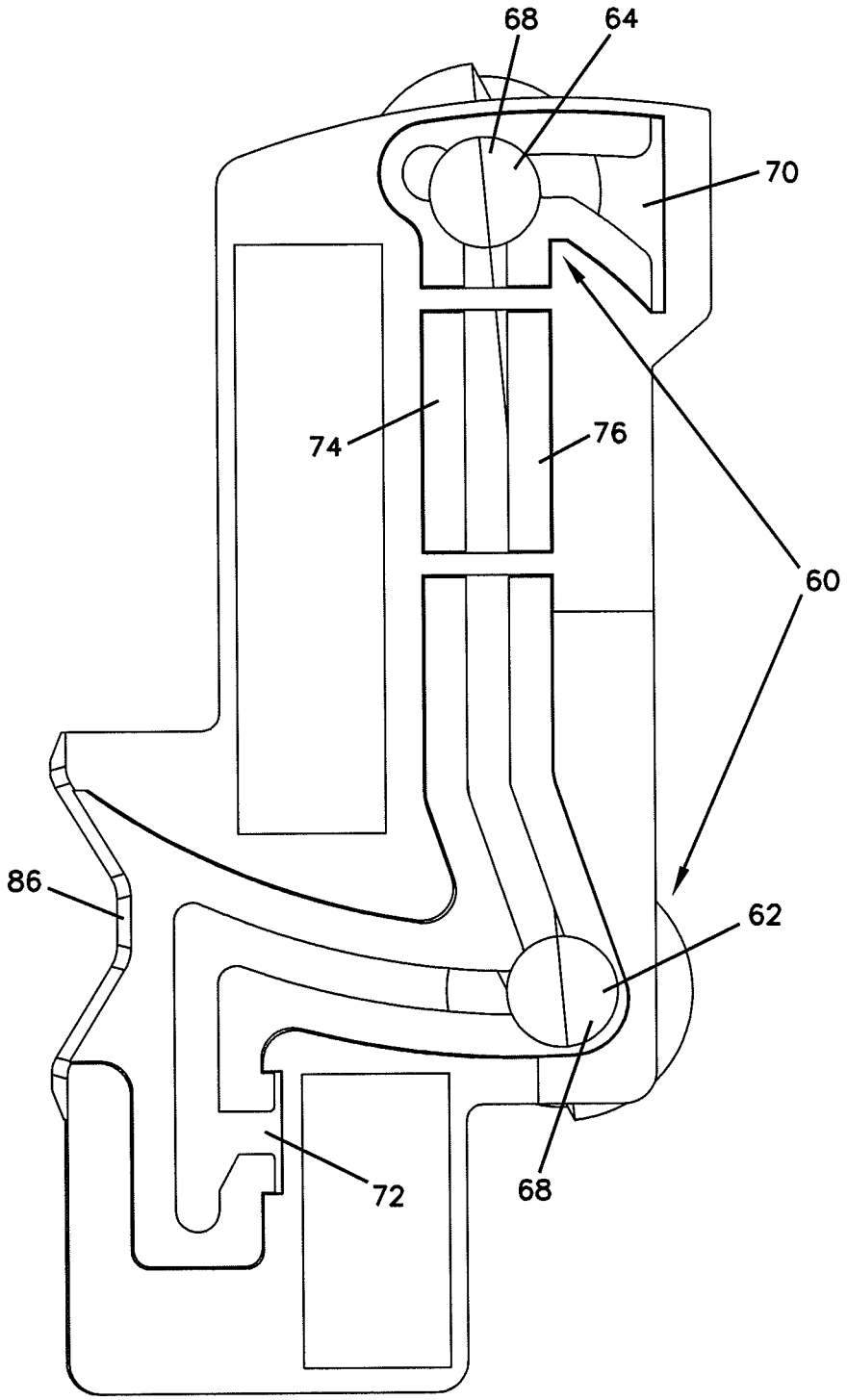
FIG. 7 is a side view of the insert of FIG. 4.

A tissue dispenser is provided that includes a tissue dispenser housing and a mandrel set. Now referring to FIGS. 2 and 3, a tissue dispenser housing is shown at reference number 20. The tissue dispenser housing 20 can be referred to as a multi-roll or two roll dispenser and can be provided for dispensing tissue such as toilet tissue. The tissue rolls are not shown but it can be readily appreciated that a first roll of tissue is provided for access through the opening or slot 22, and a second roll of tissue is provided behind the cover 24. The second roll of tissue can be characterized as a roll of tissue held in reserve. Once the first roll of tissue is depleted, the second roll of tissue can move into position so that it can be accessed through the opening or slot 22.

The reference to the roll of tissue being depleted can mean that the roll is completely depleted or substantially depleted. The terms "completely depleted" and "substantially depleted" as used herein mean all or a sufficient amount of tissue has been removed from a roll at the dispensing position to allow movement of the second roll of tissue into position so that it can be accessed through the opening or slot 22. For the sake of convenience, the term "depleted" will hereinafter be used. It should be understood that the term "depleted" encompasses both complete depletion of tissue as well as depletion to an extent that permits access of the roll of tissue held in reserve.

Figure 1:
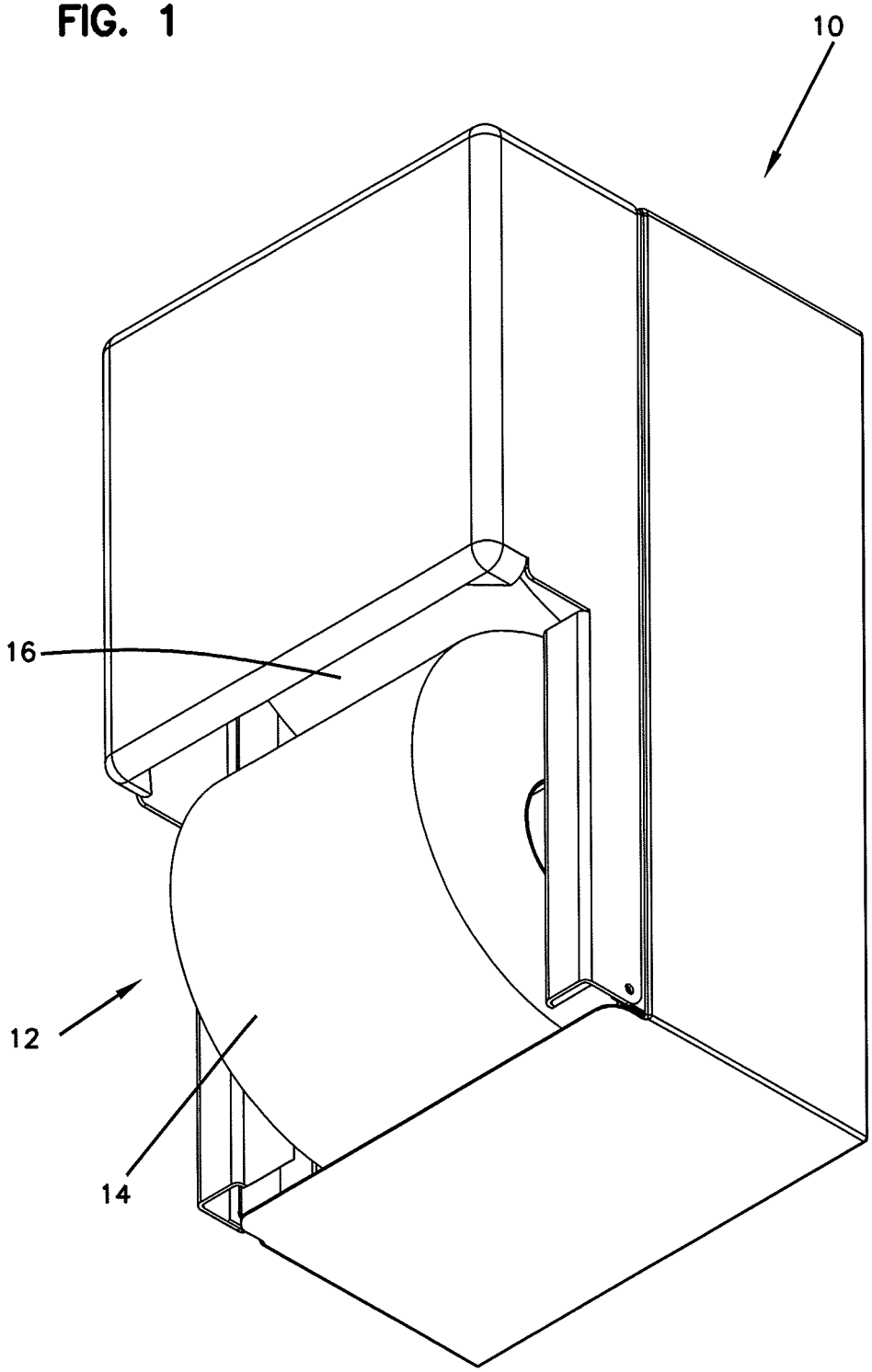
FIG. 1 is a perspective view of a prior art toilet tissue dispenser.

The tissue dispenser housing 20 includes a first side wall 26, a second side wall 28, a bottom side wall 30, a top side wall 32, and a back side wall 34. Provided on the first side wall 26 is a slot arrangement 40. Although shown on first side wall 26, the slot arrangement 40 can be provided on the second side wall 28. In addition, the slot arrangement 40 can be provided on both the first side wall 26 and the second side wall 28. The slot arrangement 40 can be constructed as part of the first side wall 26 or the second side wall 28 or both, or the slot arrangement 40 can be provided as an insert that can be attached or affixed to the first side wall 26 or the second side wall 28 or both. When provided as an insert, the slot arrangement 40 can be provided as a retrofit alternative to an existing tissue roll dispenser housing such as the disperser shown in FIG. 1. Furthermore, when provided as an insert, the slot arrangement can be attached to the side wall by adhesive or by other techniques such as mechanical fasteners including, for example, screws and clips.

The cover 24 is shown extending over at least the first side wall 26, the second side wall 28, and the top side wall 32. It should be appreciated that alternative arrangements can be provided, as desired. The cover 24 is provided to create the opening or slot 24 through which tissue can be accessed. As a result, the cover 22 can be provided so that it covers a sufficient extent to create the opening or slot 22. Furthermore, it should be understood that certain walls of the tissue dispenser housing 20 may not be necessary depending on the design of the cover 24. In addition, certain walls can be avoided if they are not needed such as, for example, the back side wall 34 and/or the bottom side wall 30.

Now referring to FIGS. 4-7, a mandrel set 44 is provided engaged with the slot arrangement 40. The slot arrangement 40 is shown insolated from the various walls of the tissue dispenser housing. The slot arrangement 40 can be provided as an insert 41. For example, the slot arrangement 40 is shown separate from the first side wall 26, the bottom side wall 30, and the back side wall 34 in order to illustrate how the mandrel set 44 moves relative to the slot arrangement 40. The mandrel set 44 engages a track 42 within the slot arrangement 40. The mandrel set 44 includes a first mandrel 48, a second mandrel 49, and an arm 50 extending from the first mandrel 48 to the second mandrel 49. The arm 50 can fix the distance between the first mandrel 48 and the second mandrel 49. The first mandrel 48 is constructed to hold a first tissue roll 52, and the second mandrel 49 is constructed to hold a second tissue roll 54.

The mandrel set 44 includes a pin arrangement 60 for engaging the slot arrangement 40. The pin arrangement 60 includes a first pin 62 and a second pin 64. The first pin 62 and the second pin 64 are constructed so that they slide within the track 42 in the slot arrangement 40. The first pin 62 and the second pin 64 each include a head 68 extending from a shaft 65 which attaches to the arm 50. It should be understood that the shaft 65 can be characterized as attaching the first pin 62 and the second pin 64 to the first mandrel 48 and the second mandrel 49, respectively. In addition, the first pin 62 and the second pin 64 can be provided on the arm 50 at locations other than locations corresponding to the first mandrel 48 and the second mandrel 49.

The track 42 extends from a track opening 70 to a track exit 72. For the track 42 shown in FIGS. 4, 6, and 7, the track opening 70 and the track exit 72 are shown extending in a forward direction toward the cover 24. It should be appreciated that the track opening and the track exit can each be provided extending in other directions. The track 42 includes a first track cover 74 and a second track cover 76. The first track cover 74 and the second track cover 76 can be provided so that they extend the length of the track 42 from the track opening 70 to the track exit 72. The first track cover 74 and the second track cover 76 can extend continuously or discontinuously the length of the track 42. The track 42 is sized so that it can receive the head 68. The first track cover 74 and the second track cover 76 extend toward each other to provide a gap 78 sized to allow the shaft 65 to pass therethrough, but not large enough to allow the head 68 to escape from the track 42. Accordingly, once the head 68 is received within the track opening 70, it is desirable for the head 68 to stay within the track 42 until it leaves the track 42 via the track exit 72. Of course, the head 68 can exit via the track opening 70. In normal operation, however, it is expected that the track head 68 will move through the track 42 from the track opening 70 to the track exit 72, and then re-enter the track 42 via the track opening 70.

The first mandrel 48 and the second mandrel 49 each include a first end 80 and a second end 82. The first end 80 is shown attached to the arm 50, and the second end 82 is shown as free floating. When provided as free floating, the second end 82 is not supported by any part of the tissue dispenser 20. The first mandrel 48 and the second mandrel 49 both include a recessed region 84. For the design shown in FIGS. 4 and 5, the recessed region 84 is provided as part of the first end 80.

The recessed region 84 is provided so that the mandrels can move past the stop 86 after the tissue roll thereon has been depleted. It should be appreciated that the recessed region can be provided at any location along the mandrel as long as the recessed region corresponds to the location of the stop so that the mandrel can by-pass the stop once the tissue roll has been depleted. For example, the recessed region 84 can be provided in the middle of the mandrel or at the second end 82. The first mandrel 48 and the second mandrel 49 are constructed to receive the first tissue roll 52 and the second tissue roll 54, respectively. The first mandrel 48 and the second mandrel 49 are constructed so that they allow the first and second tissue rolls 52 and 54 to rotate so that the tissue can be dispensed therefrom. Once the tissue on the tissue roll is depleted, a core may remain. In the case of the tissue roll utilizing a reduced core design, the core can shift as a result of the recessed region 84. Alternatively, the core can move along the mandrel in order to expose the recessed region 84. As a result, the mandrel is able to pass by the stop 86 as the mandrel set 44 moves along the track 42. Exemplary tissue rolls that can be used with the mandrel set 44 include reduced core tissue rolls. In general, reduced core tissue rolls are tissue rolls having cores comprised of first and second core sections that are spaced apart from each other to form a gap between facing ends thereof so that the total length of the core sections is less than the width of the tissue wound onto the core sections. Exemplary reduced core designs are disclosed, for example, in U.S. Pat. Nos. 7,107,888; 6,648,267; and 6,491,251.

Although reduced core tissue rolls are preferably used with the mandrel set 44, alternatives can be provided. For example, the tissue core can be fully removed from the mandrel in order to expose the recessed region 84. The core can be provided as a "bursting" type core that is sometimes used in industrial and institutional applications. Bursting cores are intended to come apart after the tissue has been removed, leaving the mandrel bare. Alternatively, the tissue roll can have a core that is manually removed once the tissue is depleted. In the case of reduced core tissue rolls, the size of the core corresponding to the recessed region 84 should be less than or equal to the size of the recessed region 84 so that the core can shift. Alternatively, the size of the gap should correspond to at least the size of the stop 86 so that the recessed region 84 is sufficiently exposed to allow the mandrel to move past the stop 86. It should be appreciated that variations of the mandrel can be used. For example, one could utilize a mandrel design as shown, for example, in U.S. Pat. No. 7,014,140, the disclosure of which is incorporated herein by reference, where the mandrel is provided having differential diameter so that the core on the smaller diameter portion can be shifted to create a gap so that the mandrel can bypass a stop.

The mandrel set 44 includes a flange or tab 51 extending from the arm 50 about midway between the first mandrel and the second mandrel 49. The flange or tab 51 can be provided having various shapes or sizes, but is generally provided to separate the rolls of tissue provided on the first mandrel 48 and the second mandrel 49. The mandrel set 44 can be provided without the tab 51, if desired. The arm 50 additionally includes a second region 53 that generally corresponds to the recessed region 84 on the first mandrel 48 and the second mandrel 49 to allow the arm 50 to pass by the stop 86. Of course, the stop 86 can be provided separate and spaced apart from the slot arrangement 40 in which case the provision of a recessed region 53 can be avoided.

Figure 8:
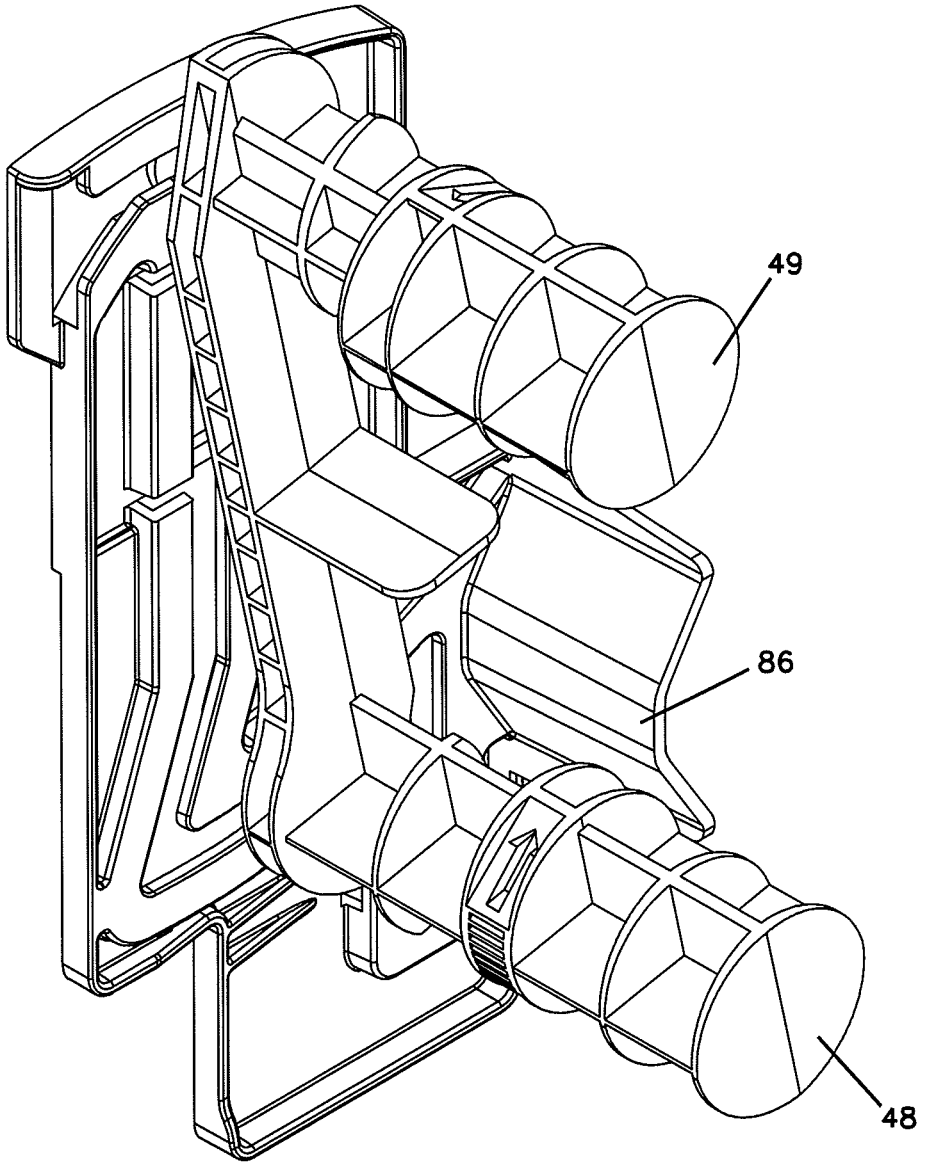
FIG. 8 is a perspective view of the insert of the tissue dispenser of FIG. 2.
Figure 9:
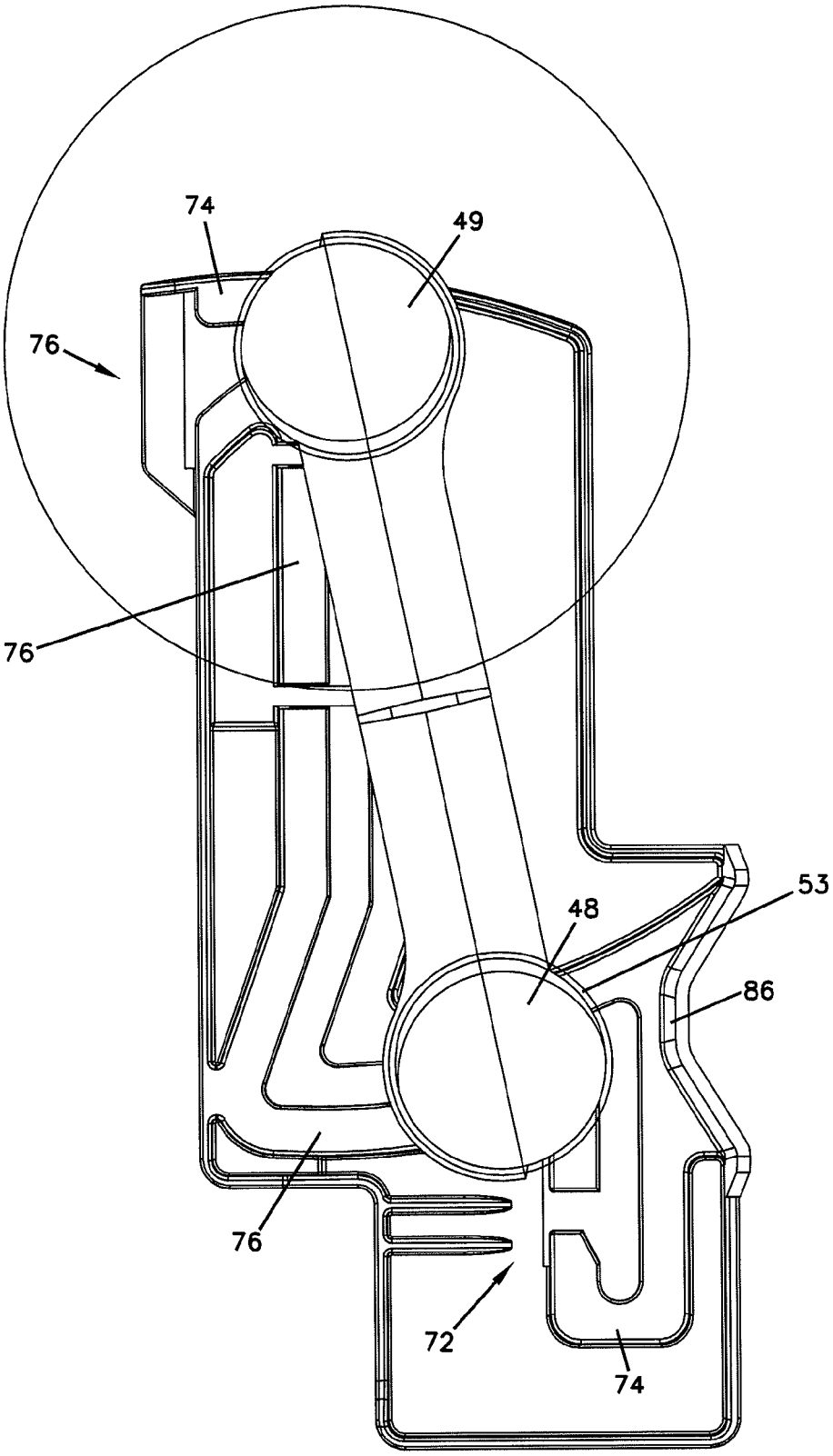
FIG. 9 is a side view of the insert of FIG. 7.
Figure 10:
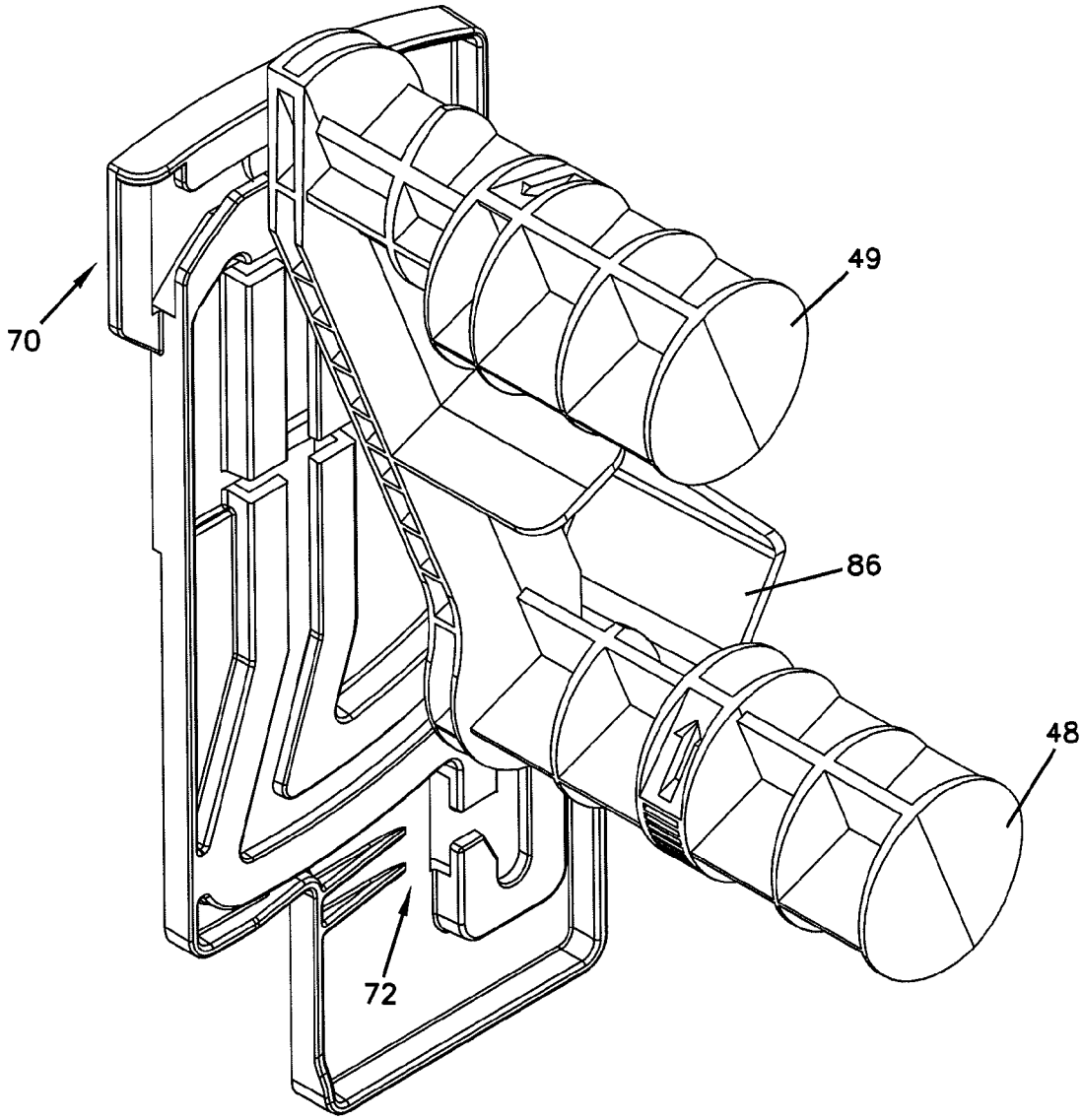
FIG. 10 is a perspective view of the insert of FIG. 2.
Figure 11:
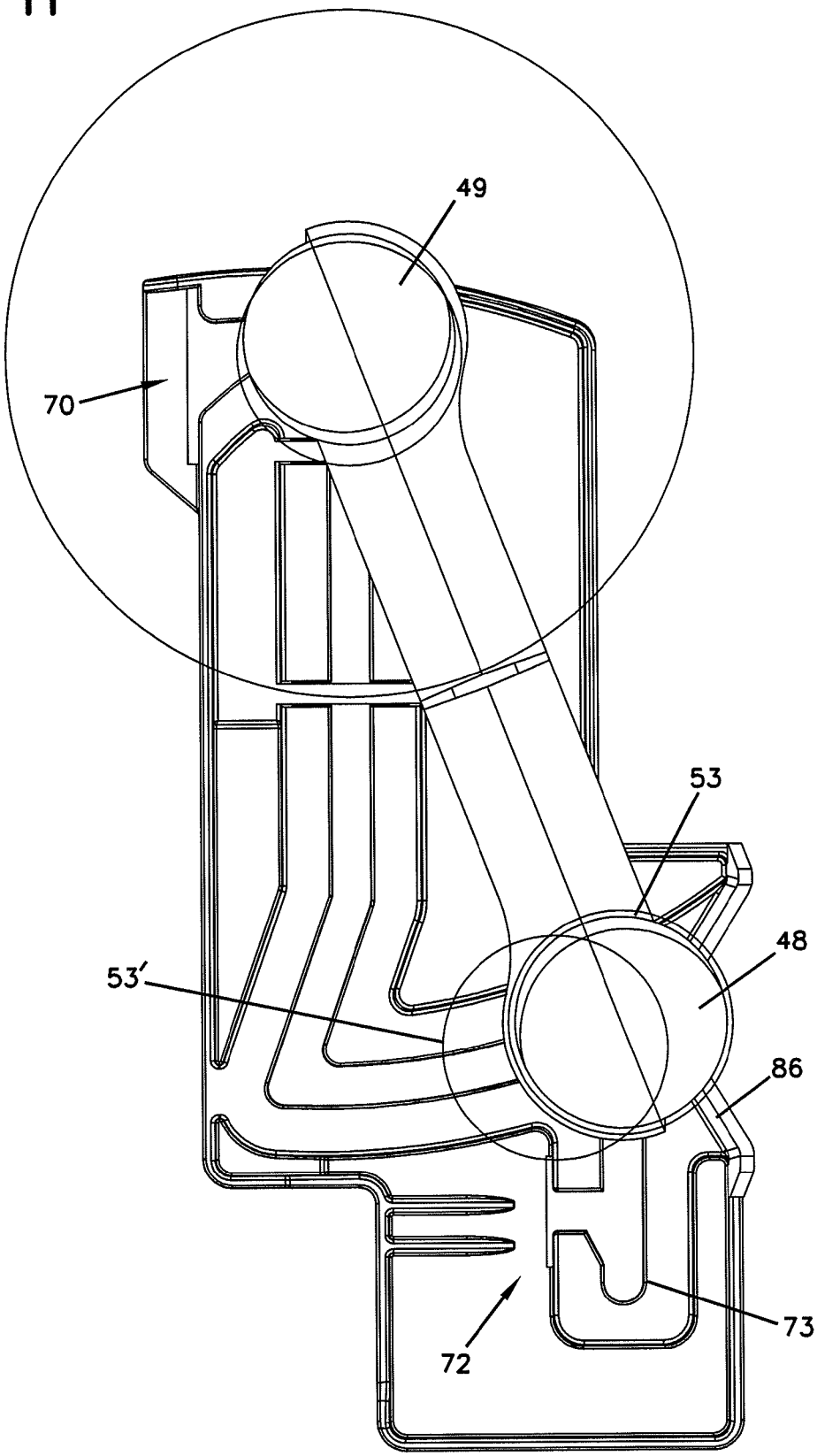
FIG. 11 is a side view of the insert of FIG. 9.
Figure 12:
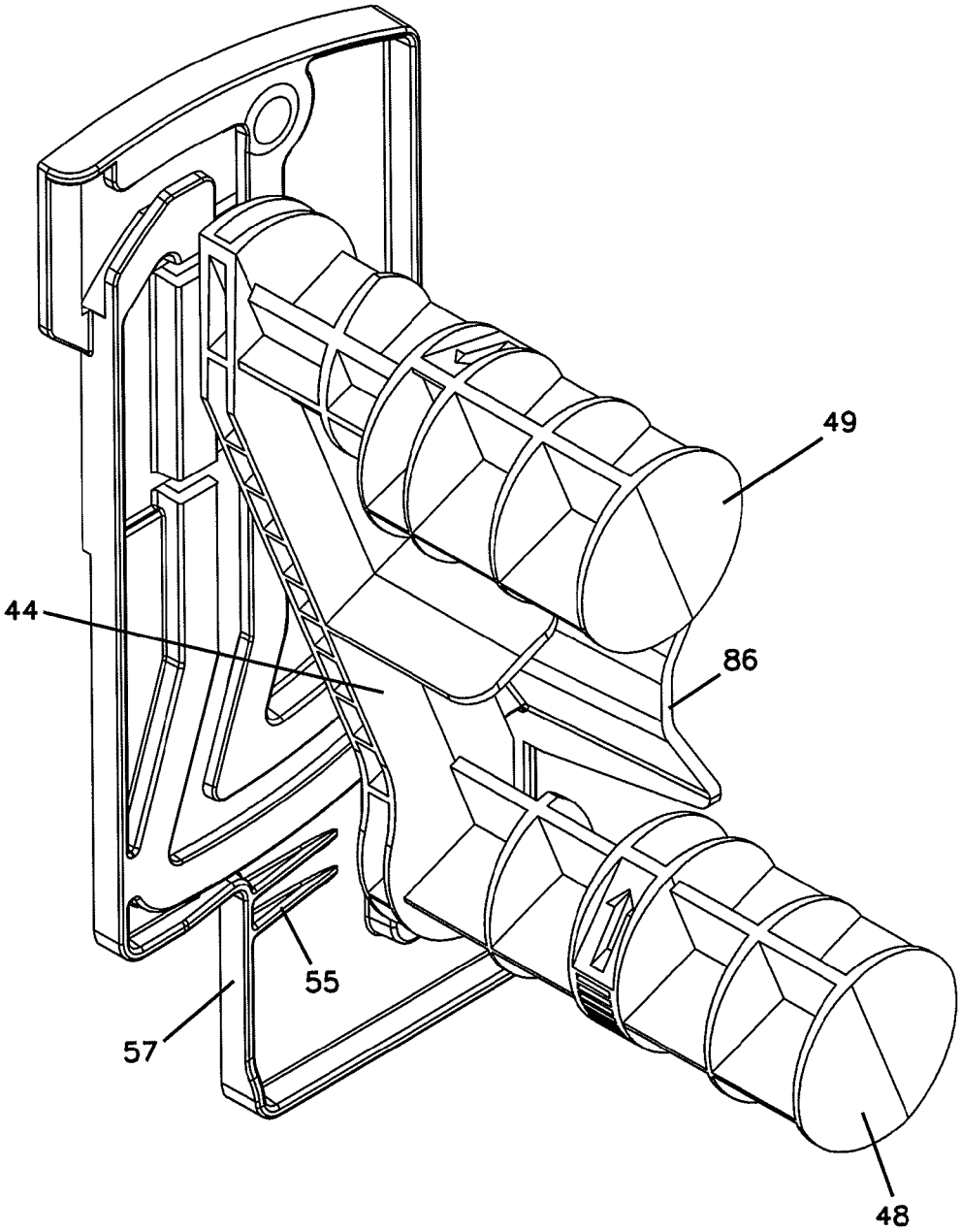
FIG. 12 is a perspective view of the insert of FIG. 2 shown in a second dispensing position.
Figure 13:
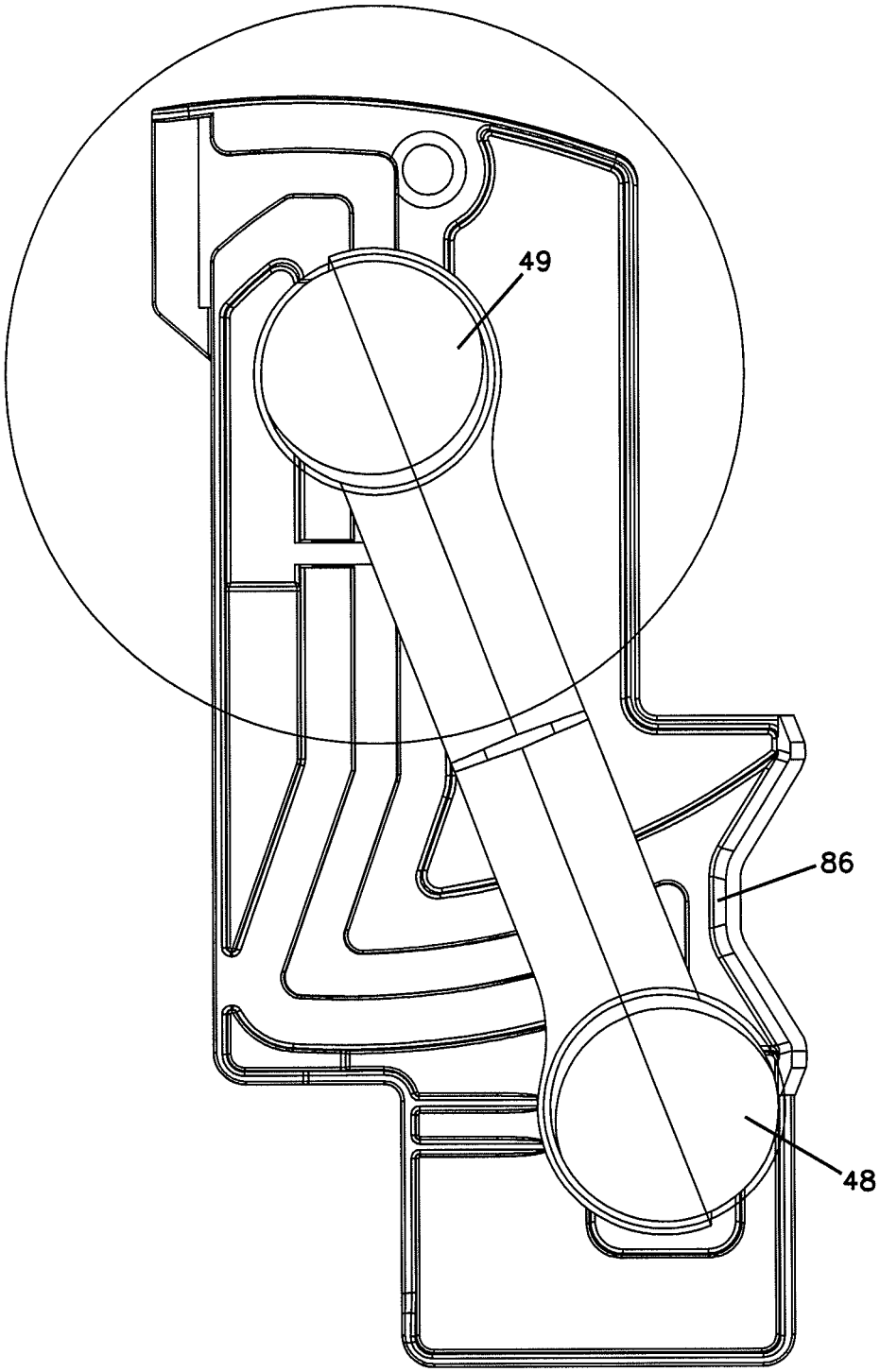
FIG. 13 is a side view of the insert of FIG. 11.

In FIGS. 4-7, the mandrel set 44 is shown engaged in the slot arrangement 40 in a first dispensing configuration 90. When in the first dispensing configuration 90, the first tissue roll 52 is available for dispensing through the slot 22 of the tissue dispenser housing 20. Once the first tissue roll 52 is depleted, the first mandrel 48 can be pushed toward the stop 86. As shown in FIGS. 8 and 9, the first mandrel 48 moves toward the stop 86, and the second mandrel 49 essentially remains in its position within the track 42. As shown in FIGS. 10 and 11, the first mandrel 48 engages the stop 86. As a result of depleting the first tissue roll 52, a reduced core 53 remains. The reduced core 53 is a split core design wherein the portion 53' provided adjacent the recessed region 84 shifts as a result of the presence of the stop 86. As a result, the first mandrel 48 can clear or move by the stop 86. As a result, the mandrel set 44 can shift vertically downward until the mandrel set 44 is in the second dispensing configuration 92 shown in FIGS. 12 and 13. While in the second dispensing configuration 92, the second tissue roll 54 can be conveniently accessed through the slot 22.

Figure 14:
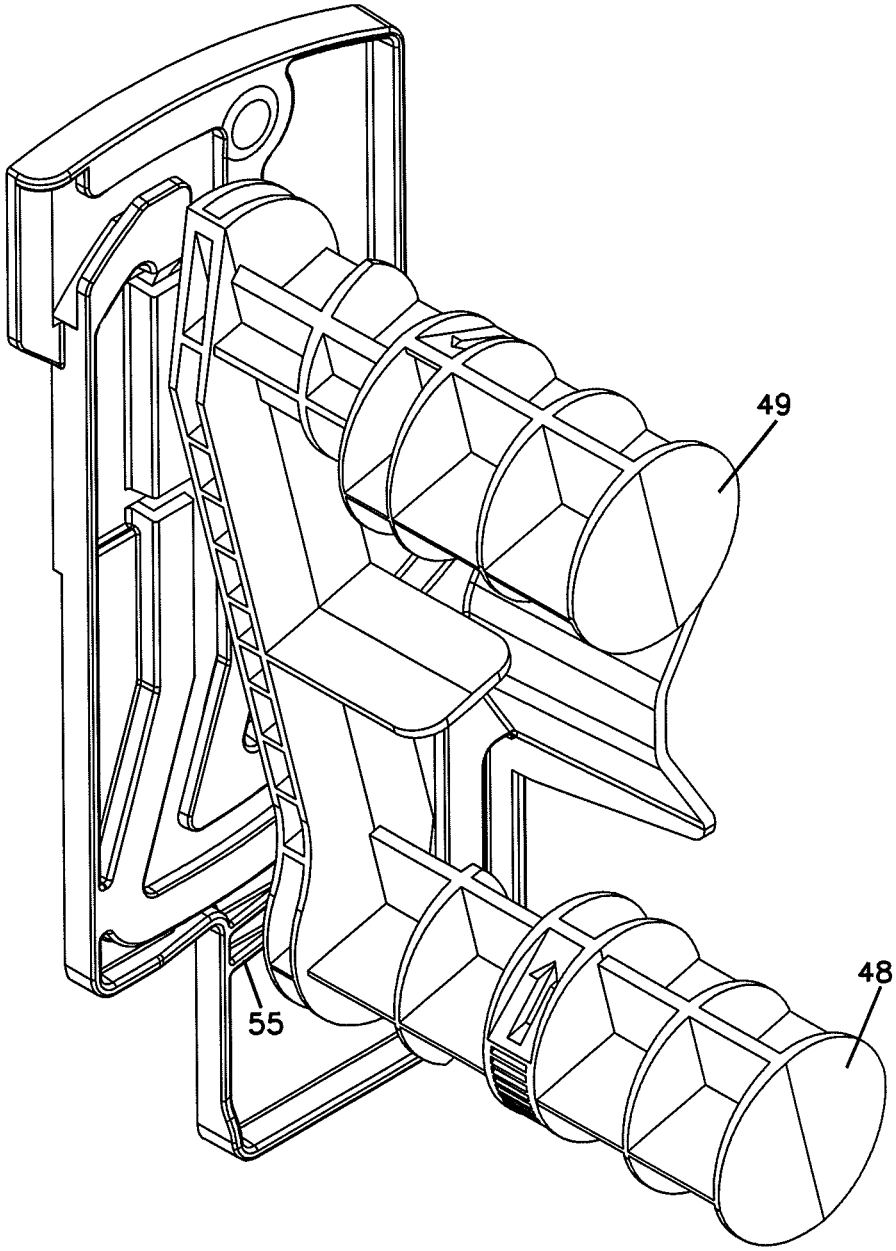
FIG. 14 is a perspective view of the insert of FIG. 2.
Figure 15:
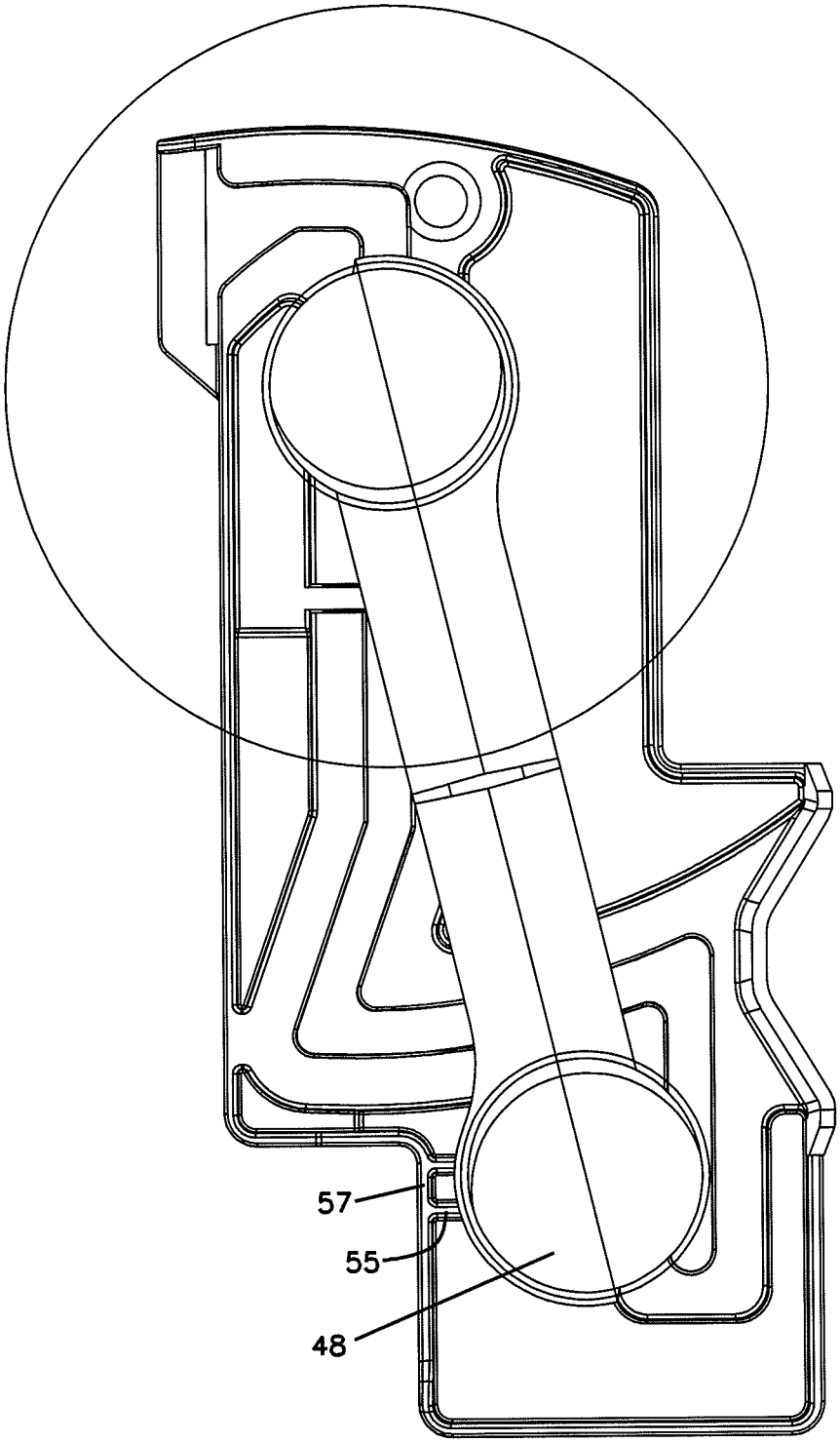
FIG. 15 is a side view of the insert of FIG. 13.
Figure 16:
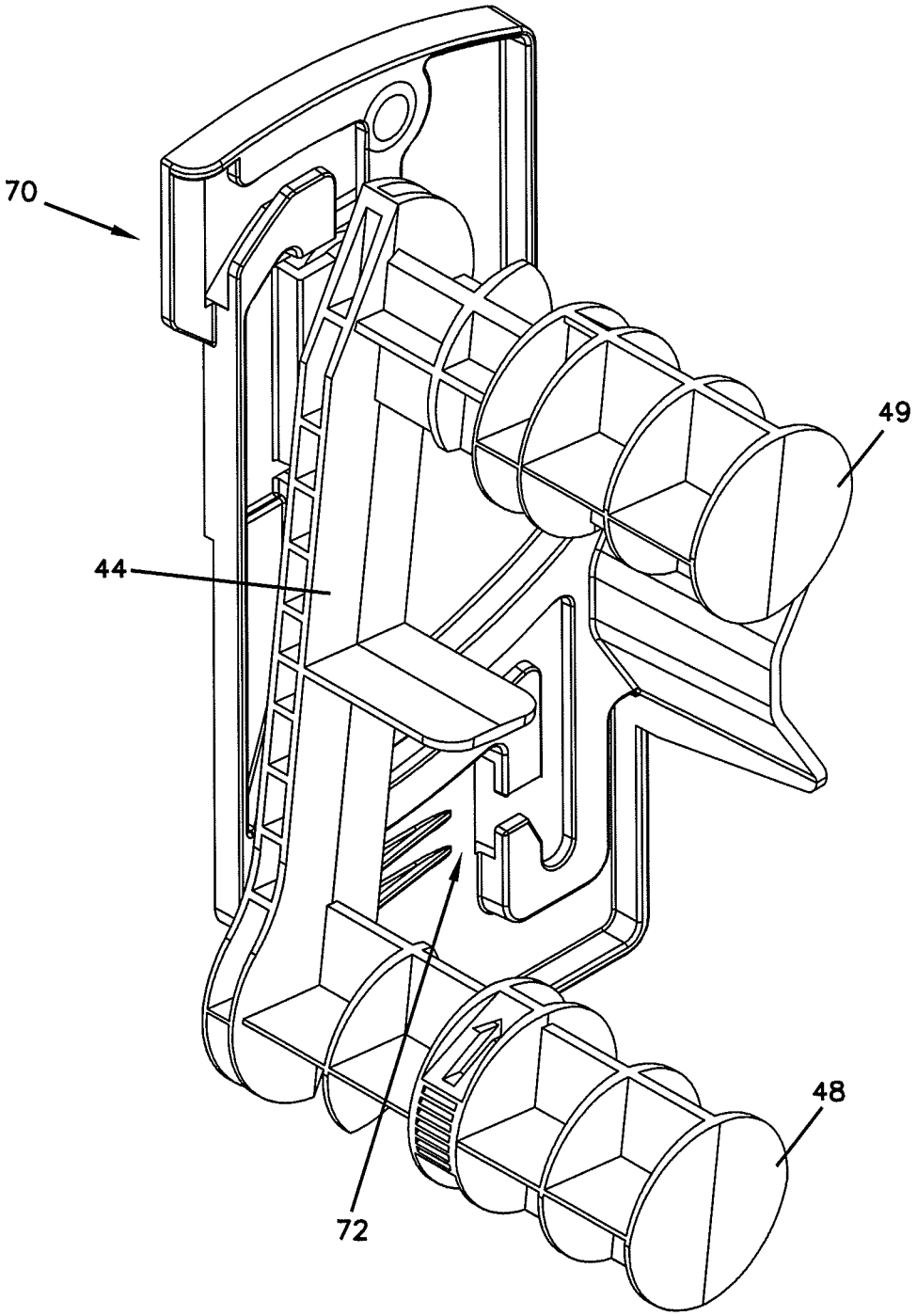
FIG. 16 is a perspective view of the insert of FIG. 2.
Figure 17:
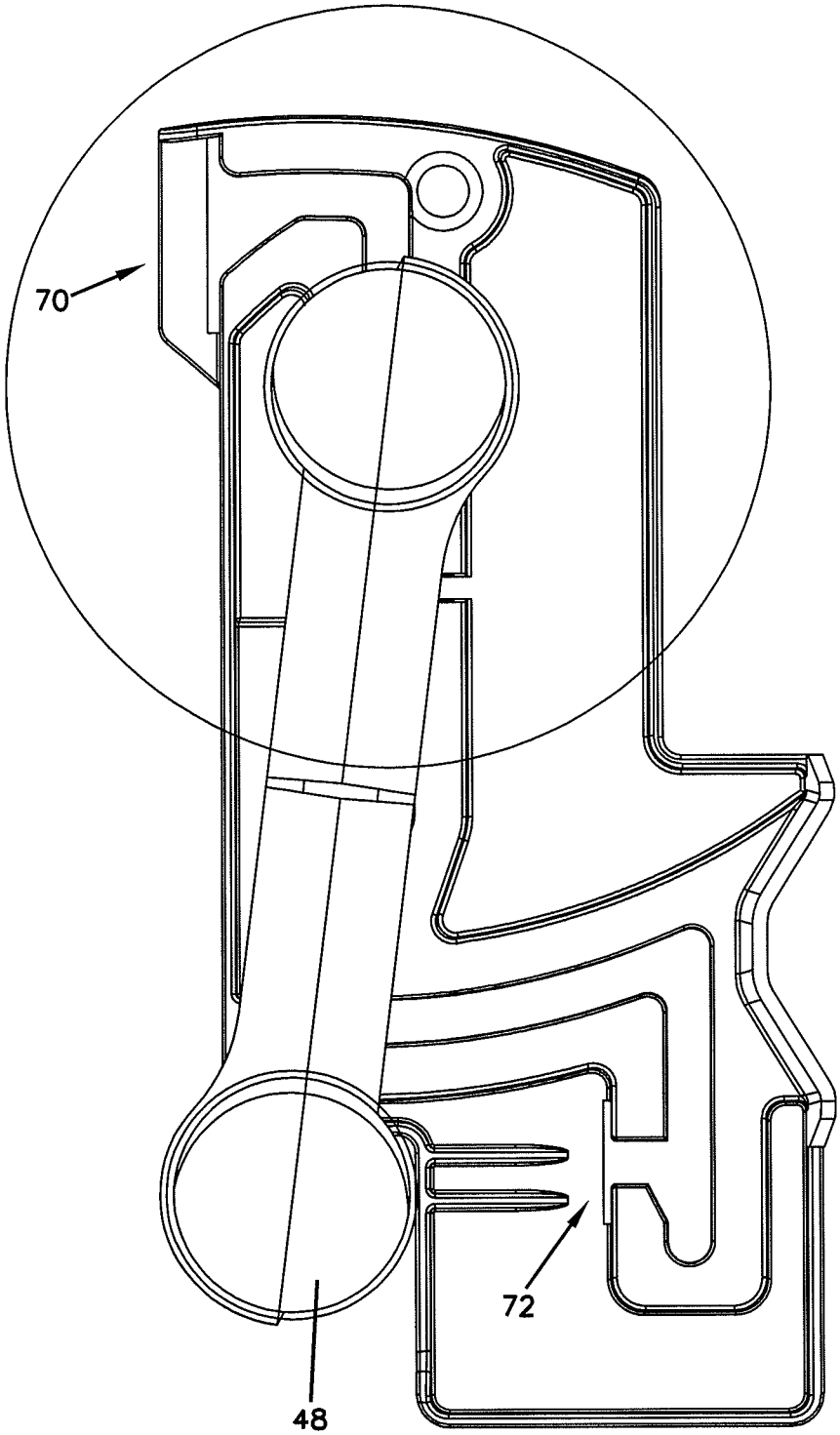
FIG. 17 is a side view of the insert of FIG. 15.
Figure 18:
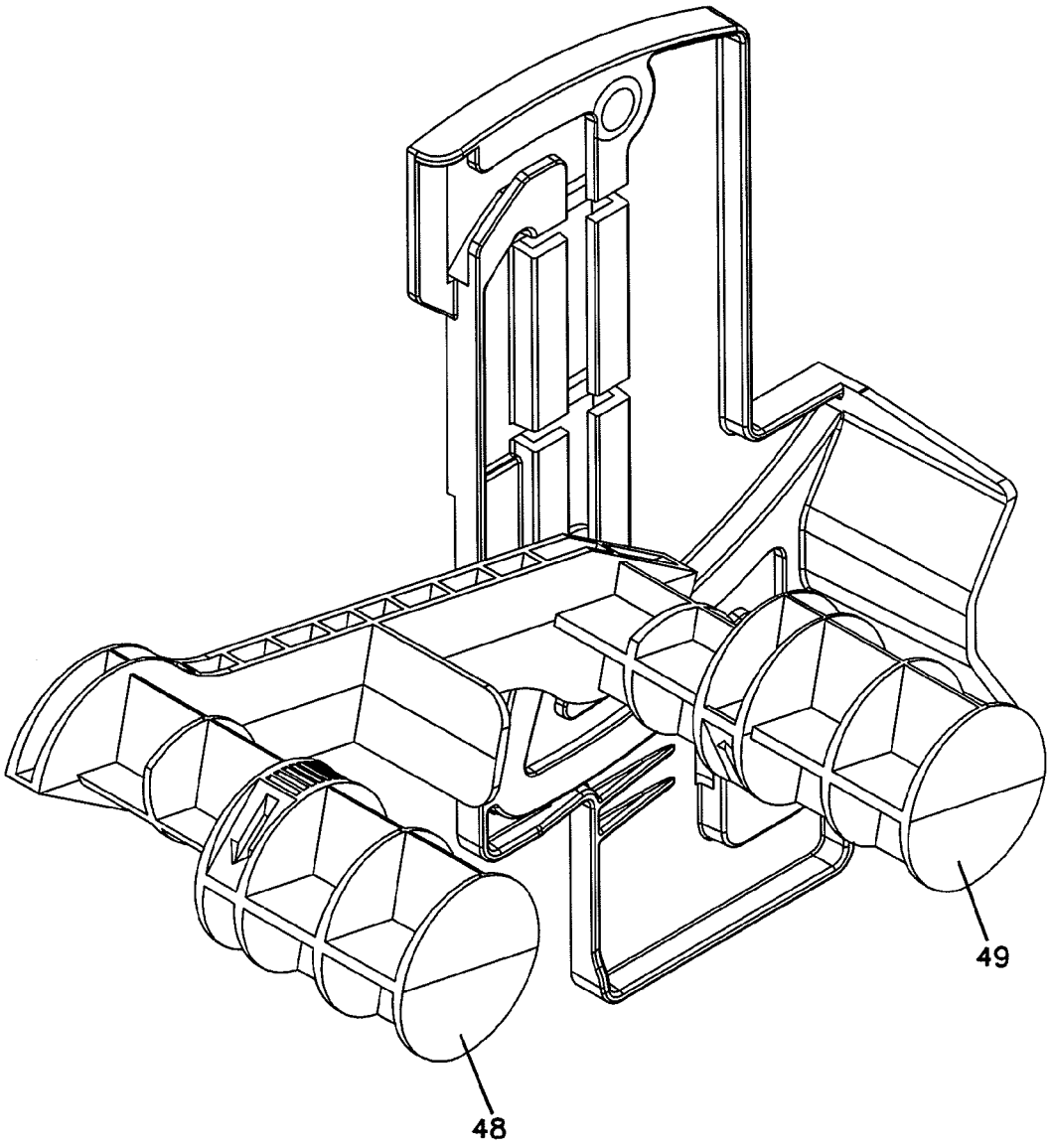
FIG. 18 is a perspective view of the insert of FIG. 2.
Figure 19:
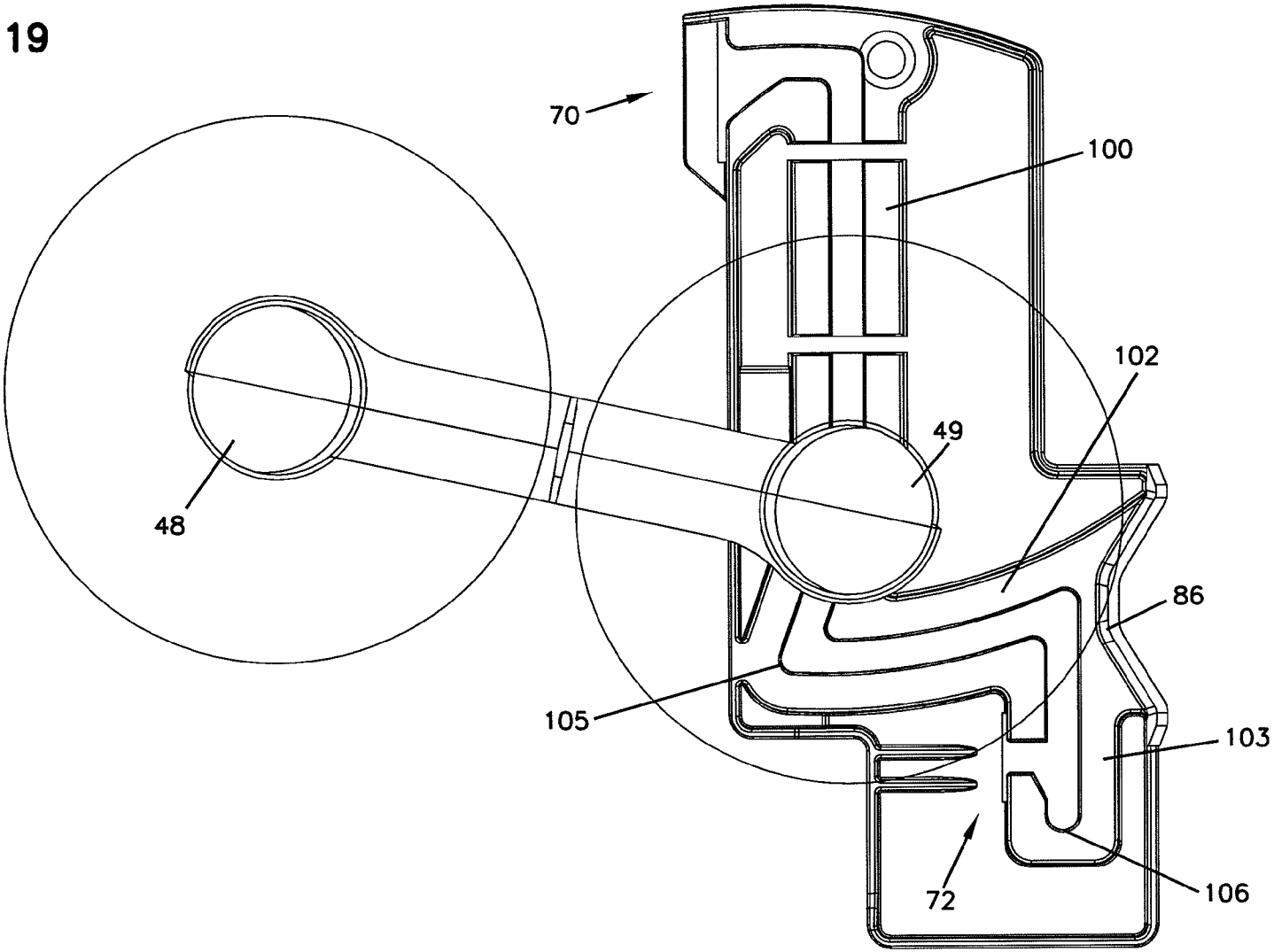
FIG. 19 is a side view of the insert of FIG. 17.
Figure 20:
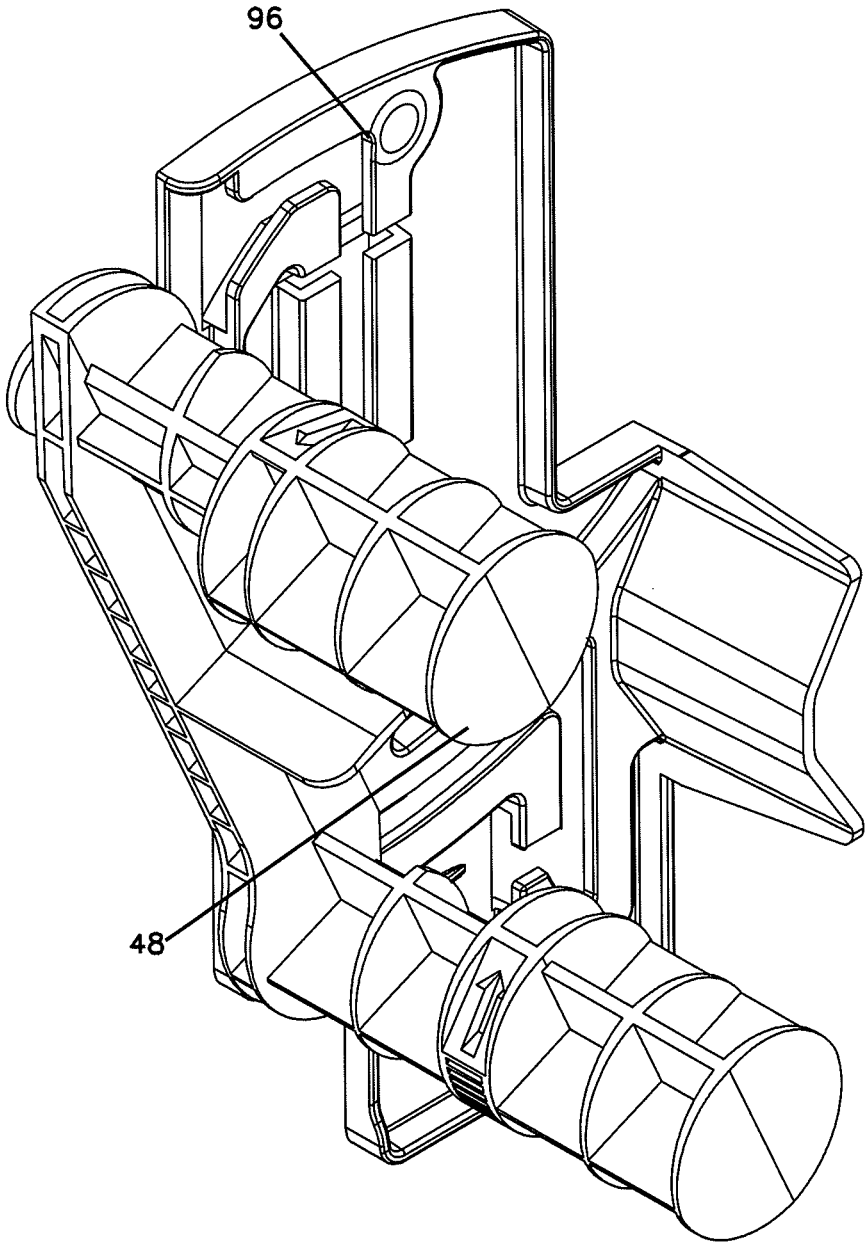
FIG. 20 is a perspective view of the insert of FIG. 2.
Figure 21:
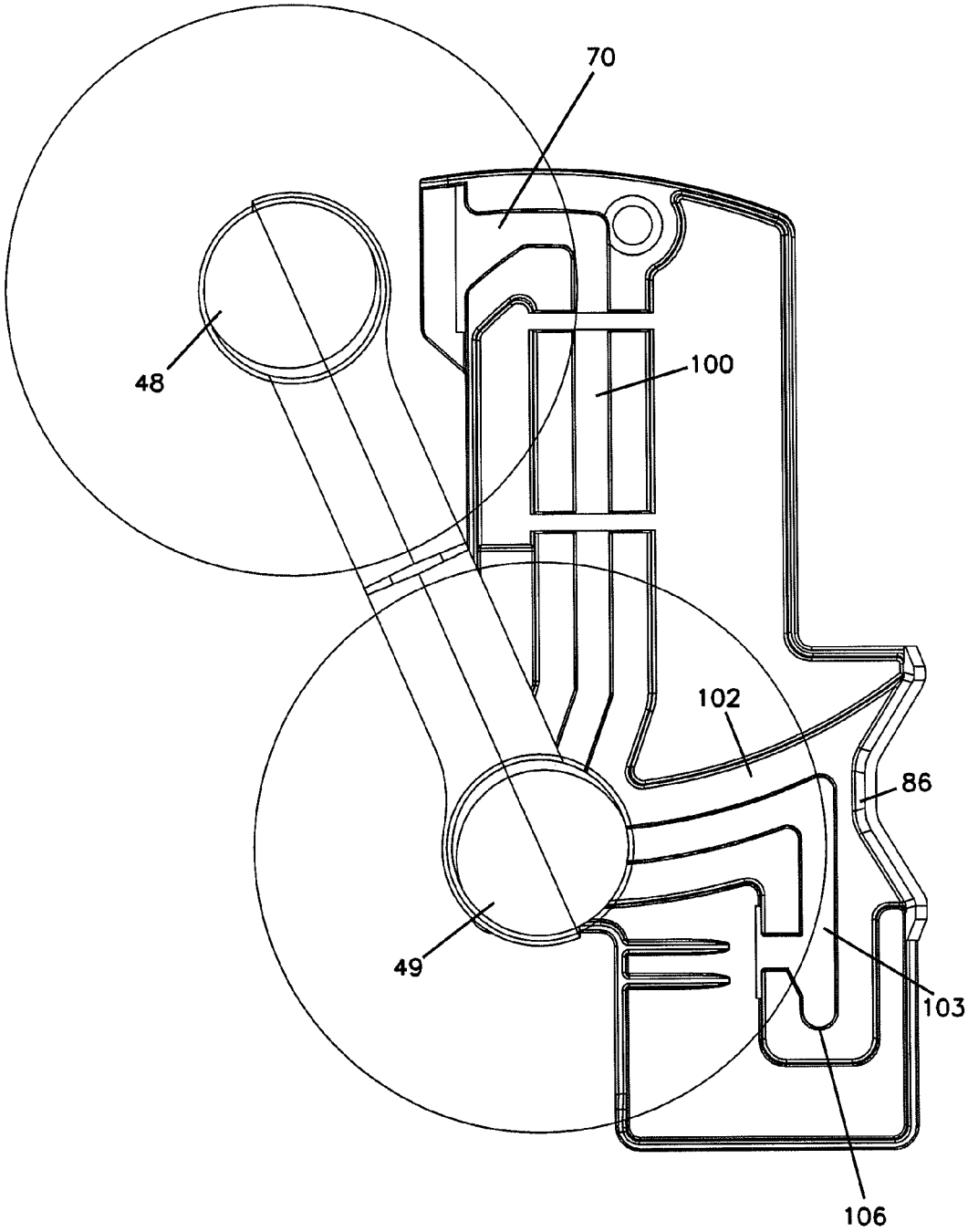
FIG. 21 is a side view of the insert of FIG. 19.

The tissue dispenser is provided so that it can be conveniently serviced by a custodian. The custodian opens the tissue dispenser housing 20 by removing or rotating the cover 24. The custodian then lifts the mandrel set 44 slightly so that the shaft and head 68 engage the track exit 72, and pulls the first mandrel 48 out of the slot arrangement 40. The slot arrangement 40 can be designed so that it is unnecessary to lift the mandrel set 44 slightly so that the head 68 engages the track exit 72. That is, in one variation, the custodian can simply pull the first mandrel 48 so that it engages the track exit. It is expected, however, that by providing a lower extension 73 below the track exit 72, tampering with the dispenser can be discouraged. Furthermore, the mandrel set 44 will likely remain in a more secure position in the second dispensing configuration 92. In FIGS. 14 and 15, the first mandrel 48 is shown engaging the track exit 72. As the first mandrel 48 moves through the track exit 72, the head 68 engages the ramp 55 so that the head 68 clears the edge 57 of the slot arrangement 40. As shown in FIGS. 16 and 17, the mandrel set 44 is rotated so that the first mandrel 48 rotates to completely expose the first mandrel 48 so that a new tissue roll can be placed thereon. The custodian removes any core parts remaining on the first mandrel 48, and then places a new tissue roll on the first mandrel 48. See FIGS. 18 and 19. At the same time, the mandrel set 44 shifts downward in the track 42. As shown in FIGS. 20 and 21, the first mandrel 48 then enters the track 42 at the track opening 70. The first mandrel 48 is then pushed until it no longer moves. At that point, the mandrel set 44 is provided in the first dispensing configuration 90. The second mandrel 49 is available for dispensing tissue, and once the tissue is depleted, the second mandrel 49 can move past the stop 86 so that the mandrel set 44 can move into the second dispensing configuration 92. It should be appreciated that as a result of this rotation, the first mandrel 48 and the second mandrel 49 shift positions and the first mandrel 48 can be referred to as the second mandrel 49, and the second mandrel 49 can be referred to as the first mandrel 48. For convenience, the mandrels can be referred to as the lower mandrel or the upper mandrel. When the mandrel set 44 is provided in the first dispensing configuration 90, the lower mandrel is the mandrel available for dispensing. When the mandrel set 44 is provided in the second dispensing configuration 92, the upper mandrel is the mandrel available for dispensing.

Once the mandrel set 44 is returned to the first dispensing configuration 90, the custodian can replace the cover 24. The process can be repeated thereby requiring complete dispensing of a roll of tissue before a new roll is available. If desired, the custodian can back the entire mandrel set out of the slot arrangement 40 in order to replace both rolls even if the second roll has not been fully depleted.

The movement of a mandrel through the track 42 can be characterized as a generally downward movement through the first region 100, a generally rearward movement through the second region 102, and a generally downward movement through the third region 103. The first region 100 can be characterized as the region extending from the entry 70 to the bend 105 where the first mandrel 48 is located in the first dispensing configuration 90. The second region 102 can be referred to as the region extending from the bend 105 to the stop 86. The third region 103 can be characterized as the region extending from the stop 86 to the lower end 106 which is where the first mandrel 48 is located when provided in the second dispensing configuration 92. The region first 100 can include a generally rearward movement at the entry 70, and the movement at the third region 103 can be characterized as a forward movement at the exit 72. In addition, the movement within the first region 100 can be characterized as generally downward and forward. The movement in the second region 102 can be characterized as generally rearward and upward. In addition, the movement in third region 103 can be characterized as generally downward, and then upward and forward through the exit 72.

Figure 22:
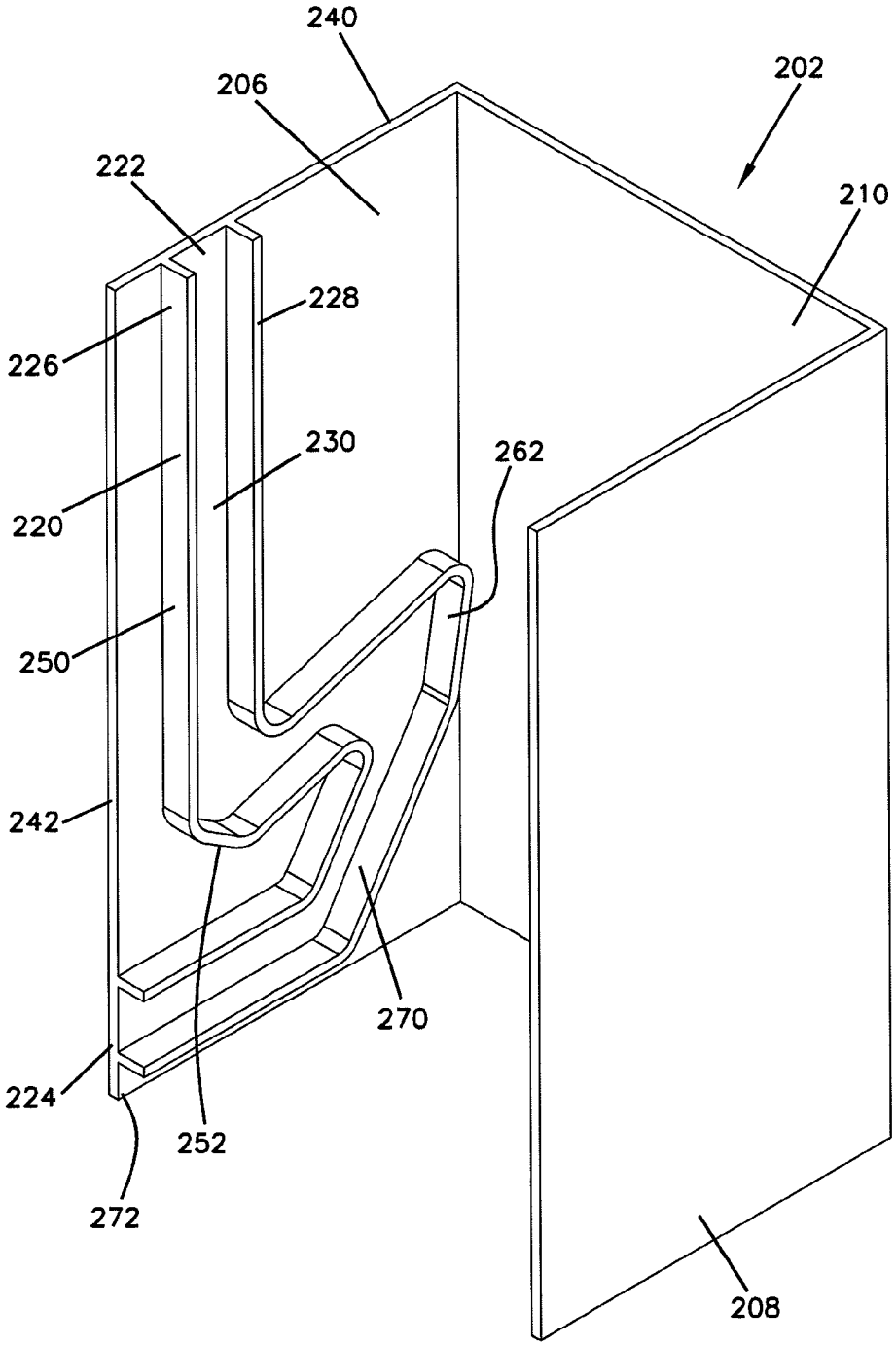
FIG. 22 is a perspective view of an alternative tissue dispenser housing according to the principles of the invention.
Figure 23:
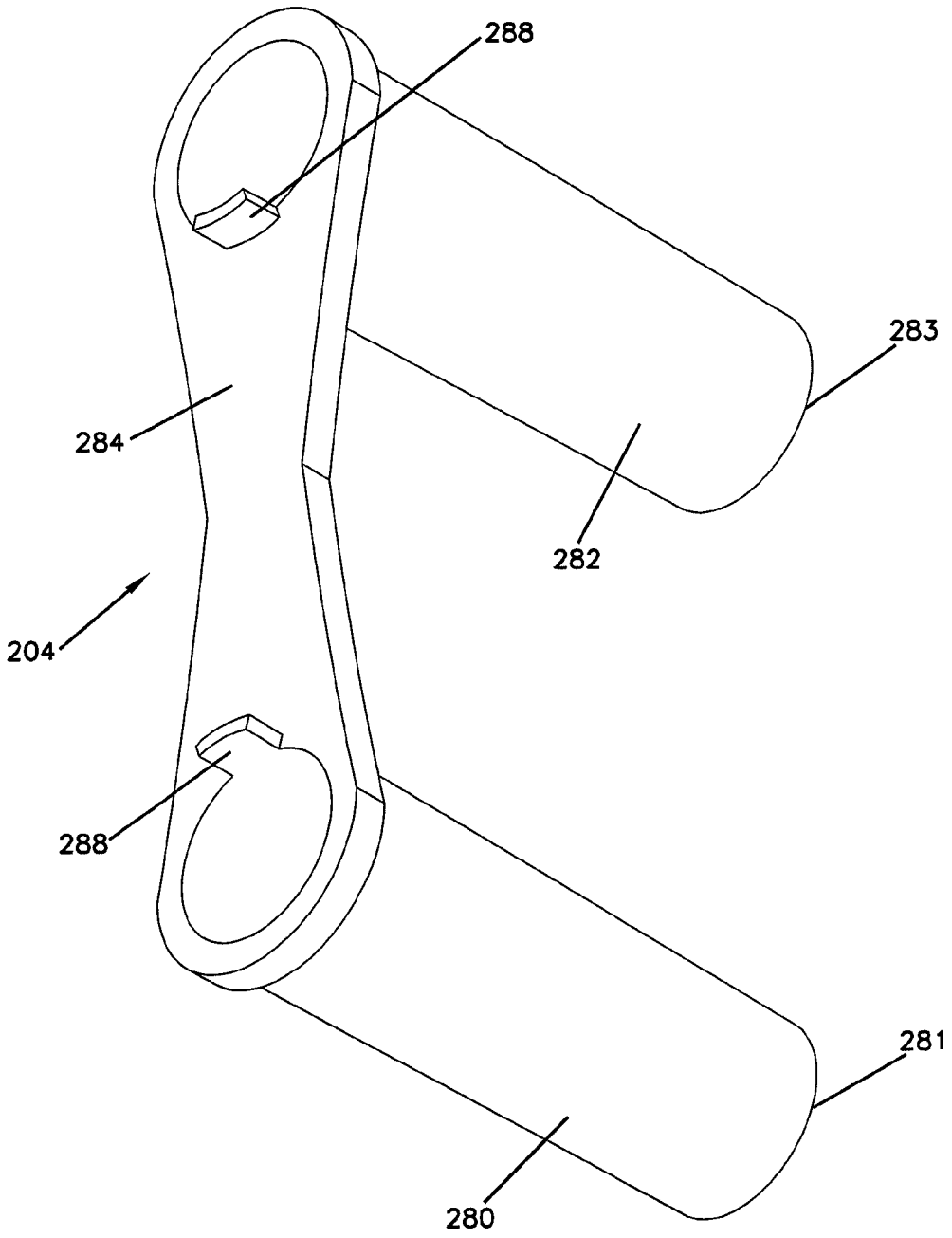
FIG. 23 is a perspective view of an alternative mandrel set for use in the housing of FIG. 22.
Figure 24:
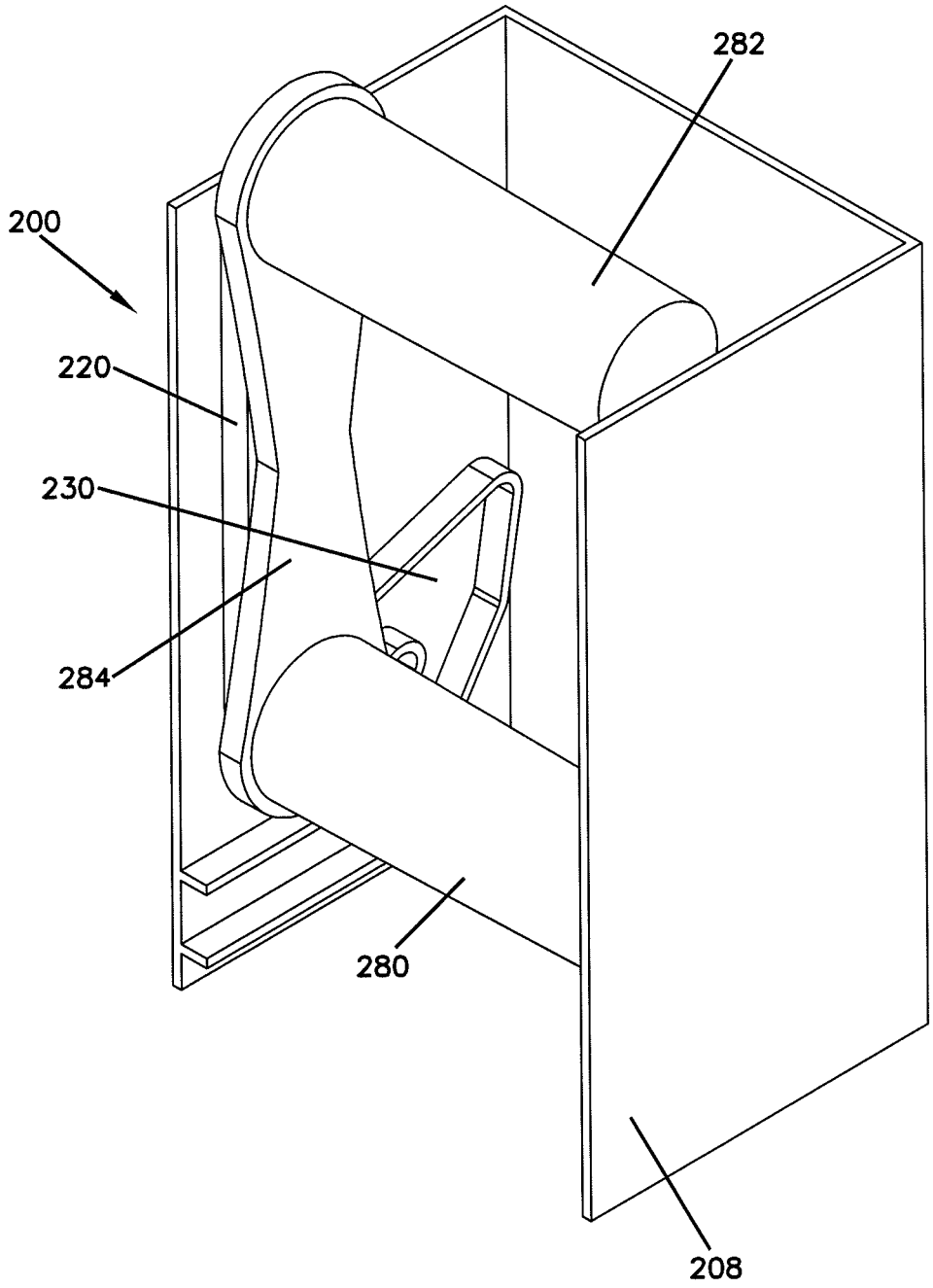
FIG. 24 is a perspective view of the housing and mandrel set of FIGS. 22 and 23.

Now referring to FIGS. 22-24, a portion of an alternative tissue dispenser is shown at reference number 200. The tissue dispenser 200 includes a tissue dispenser housing 202 and a mandrel set 204. The tissue dispenser housing 202 includes a first side wall 206, a second side wall 208, and a back side wall 210. Provided on the first side wall 206 is a slot arrangement 220. The slot arrangement 220 includes a slot opening 222, a slot exit 224, and walls 226 and 228 that define the slot area 230. The slot opening 222 is shown extending through the top portion 240 of the tissue dispenser housing 202. In addition, the slot exit 224 is shown extending through the front portion 242 of the tissue dispenser housing 202. The slot arrangement 220 is shown having a path generally corresponding to the slot arrangement 40 shown in FIG. 2. That is, the slot arrangement 220 includes a first region 250 that extends generally vertically from the slot opening 222 to a first bend 252, a second region 260 extending from the first bend 252 to a second bend 262 in a generally horizontal direction. In addition, a third region 270 is provided extending from the second bend 262 toward the slot outlet 224. The third region 270 extends generally downwardly and toward the dispenser housing bottom 272. The mandrel set 204 includes a first mandrel 280, and second mandrel 282, and an arm 284. The arm 284 includes posts 288. The posts 288 are provided so that they engage the slot area 230 and causes the mandrel set 204 to follow and stay within the slot arrangement 220. It should be appreciated that the posts 288 do not extend from the center of the mandrel 280 and 282, but are instead offset from the center of the mandrels 280 and 282.

It should be appreciated that the embodiment shown in FIG. 22-24 can include a cover, a stop, and a recessed area in the mandrels as shown and described in the context of the tissue dispenser housing and mandrel set shown in FIGS. 2-21. Furthermore, the mandrel set stays within the slot area 230 as a result of the presence of the second side wall 208 which limits the horizontal movement of the mandrel set 204. For the embodiment shown in FIGS. 22-24, the first ends 281 and 283 of the mandrels 280 and 282 are free floating but are limited in their ability to move horizontally as a result of being placed between the first side wall 206 and the second side wall 208. If desired, a slot arrangement can be provided along the second side wall 208 in order to help contain the mandrel set 204 within the slot area 230.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A tissue dispenser comprising:

(a) a housing for storing and dispensing multiple rolls of tissue, the housing comprising a first side wall and a cover constructed to provide an opening through which tissue can be dispensed, a track extending along a portion of the first side wall, and a stop;

(b) a mandrel set comprising a first mandrel constructed to hold a first roll of tissue, a second mandrel constructed to hold a second roll of tissue, and an arm extending from the first mandrel to the second mandrel, the arm including a first pin and a second pin wherein the first pin and the second pin are constructed to engage and travel along the track, wherein the first mandrel comprises a recessed region and the second mandrel comprises a recessed region, and the stop engages the first recessed region of the first mandrel and the recessed region of the first mandrel when the first mandrel and the second mandrel by-pass the stop; and (c) the tissue dispenser is constructed so that the first roll of tissue on the first mandrel can be dispensed from the opening while the second roll of tissue on the second mandrel is held in reserve, and once the first roll of tissue on the first mandrel is depleted, the mandrel set can move along the track so that the first mandrel by-passes the stop and the roll of tissue on the second mandrel can be dispensed from the opening, and wherein the stop prevents the first mandrel from by-passing the stop prior to the roll of tissue on the first mandrel being depleted, wherein the recessed region of the first mandrel forms a radially recessed region relative to a non-recessed region of the first mandrel, and the recessed region of the second mandrel forms a radially recessed region relative to a non-recessed region of the second mandrel.

2. A tissue dispenser according to claim 1, wherein the cover is constructed for opening to provide access to an interior of the housing.

3. A tissue dispenser according to claim 2, wherein the track is constructed to allow removal of the mandrel set when the cover is opened from the track.

4. A tissue dispenser according to claim 3, wherein the track includes a track inlet and a track exit.

5. A tissue dispenser according to claim 4, wherein the track comprises a first track cover and a second track cover, and the first pin and the second pin comprise a shaft and a head, and the mandrel set engages the track so that the head can be removed from the track at the track inlet or the track exit.

6. A tissue dispenser according to claim 1, wherein the housing comprises the first side wall and an opposite second side wall, and wherein the first pin and the second pin are held within the track by the first side wall and the second side wall.

7. A tissue dispenser according to claim 1, further comprising a stop which prevents the mandrel set from moving from a first dispensing configuration, where the roll of tissue on the first mandrel is dispensed, to a second dispensing configuration, where the roll of tissue on the second mandrel can be dispensed, until the roll of tissue on the first mandrel is depleted.

8. A method for dispensing tissue from a tissue dispenser comprising:

(a) dispensing tissue through an opening in a tissue dispenser housing from a lower mandrel of a mandrel set in a first dispensing configuration until the tissue is fully dispensed, the mandrel set having an upper mandrel and the lower mandrel, and the lower mandrel having a recessed region and the upper mandrel a having recessed region;

(b) displacing the lower mandrel so that the lower mandrel by-passes a stop wherein the stop extends beyond an outer periphery of the lower mandrel and into the recessed region; and (c) displacing the mandrel set into a second dispensing configuration for dispensing tissue from the upper mandrel through the opening, wherein the mandrel set has an arm separating the lower mandrel and the upper mandrel, and a pin arrangement so that the mandrel set moves along a track, wherein the recessed region of the lower mandrel forms a radially recessed region relative to a non-recessed region of the lower mandrel, and the recessed region of the upper mandrel forms a radially recessed region relative to a non-recessed region of the upper mandrel.

9. A method according to claim 8, further comprising:

(a) removing a core from a roll of tissue provided on the lower mandrel prior to displacing the lower mandrel so that the mandrel set moves into the second dispensing configuration.

10. A method according to claim 8, further comprising:

(a) moving a core from a roll of tissue provided on the lower mandrel prior to displacing the lower mandrel so that the mandrel set moves into the second dispensing configuration.

11. A method according to claim 8, wherein the tissue dispenser comprises a first side wall and the track extends along the first side wall.

12. A method according to claim 11, wherein the track includes a track inlet and a track exit that allows for removal of the mandrel set from the track.

13. A method according to claim 8, wherein the pin arrangement comprises a first pin and a second pin.

14. A method according to claim 13, wherein the track comprises a first track cover and a second track cover, and the first pin and the second pin comprise a shaft and a head and the mandrel set engages the track so that the head can be removed from the track only at the track inlet or the track exist.

15. A method according to claim 13, wherein the wherein the housing comprises the first side wall and an opposite second side wall, and wherein the first pin and the second pin are held within the track by the first side wall and the second side wall.

16. A tissue dispenser insert constructed for retrofitting a tissue dispenser housing, the tissue dispenser insert comprises:

(a) a track having a track inlet, a track outlet, and a track length extending from the track inlet to the track outlet, the track length constructed to provide a first dispensing location and a second dispensing location;

(b) a mandrel set comprising a first mandrel constructed to hold a first roll of tissue, a second mandrel constructed to hold a second roll of tissue, and an arm extending from the first mandrel to the second mandrel, the first mandrel comprising a recessed region and the second mandrel comprising a recessed region, the arm including a first pin and a second pin wherein the first pin and the second pin are constructed to engage and travel along the track from the track inlet to the track outlet; and (c) a stop constructed to engage the recessed region of the first mandrel to prevent the first mandrel from by-passing the stop when the first roll of tissue is provided on the first mandrel, wherein the recessed region of the first mandrel forms a radially recessed region relative to a non-recessed region of the first mandrel, and the recessed region of the second mandrel forms a radially recessed region relative to a non-recessed region of the second mandrel.

17. A tissue dispenser insert according to claim 16, wherein the track comprises a first track cover and a second track cover, and the first pin and the second pin comprise a shaft and head, and the mandrel set engages the track so that the head travels along the track and can be removed from the track at the track inlet or the track outlet.

18. A tissue dispenser insert according to claim 16, wherein the insert comprises a stop which prevents the mandrel set from moving from a first dispensing configuration, wherein the roll of tissue on the first mandrel can be dispensed, to a second dispensing configuration, where the roll of tissue on the second mandrel can be dispensed, until the roll of tissue on the first mandrel is depleted.

19. A tissue dispenser according to claim 16, wherein the stop engages the recessed region of the first mandrel and the recessed region of the second mandrel when the first mandrel and the second mandrel by-pass the stop.

* * * * *